US010991304B2

(12) United States Patent
Furihata et al.

(10) Patent No.: US 10,991,304 B2
(45) **Date of Patent: *Apr. 27, 2021**

(54) COMPRESSED DATA TRANSMISSION IN PANEL DISPLAY SYSTEM

(71) Applicant: SYNAPTICS INCORPORATED, San Jose, CA (US)

(72) Inventors: Hirobumi Furihata, Tokyo (JP); Damien Berget, Sunnyvale, CA (US); Takashi Nose, Tokyo (JP); Joseph Kurth Reynolds, San Jose, CA (US)

(73) Assignee: Synaptics Incorporated, San Jose, CA (US)

( * ) Notice: Subject to any disclaimer, the term of this patent is extended or adjusted under 35 U.S.C. 154(b) by 7 days.

This patent is subject to a terminal disclaimer.

(21) Appl. No.: 16/223,508

(22) Filed: Dec. 18, 2018

(65) Prior Publication Data

US 2019/0122613 A1 Apr. 25, 2019

Related U.S. Application Data

(63) Continuation of application No. 15/594,327, filed on May 12, 2017, now Pat. No. 10,176,761.
(Continued)

(51) Int. Cl.
*G09G 3/3258* (2016.01)
*G09G 3/3291* (2016.01)
(Continued)

(52) U.S. Cl.
CPC ..... *G09G 3/3258* (2013.01); *G09G 3/2011* (2013.01); *G09G 3/3275* (2013.01);
(Continued)

(58) Field of Classification Search
CPC ..... G09G 2340/02; G09G 2310/027; G09G 5/395; G09G 3/3291; G09G 3/2011; G09G 3/3258
See application file for complete search history.

(56) References Cited

U.S. PATENT DOCUMENTS 8,022,908 B2 9/2011 Mizukoshi et al.
8,291,129 B2 10/2012 Tamatani
(Continued)

FOREIGN PATENT DOCUMENTS

JP H4177916 A 6/1992
JP H6237448 A 8/1994

*Primary Examiner* — Yu Chen
(74) *Attorney, Agent, or Firm* — Ferguson Braswell Fraser Kubasta PC

(57) ABSTRACT

A host device divides original data into first to $N^{th}$ stream data for N being an integer of two or more, generates first to $N^{th}$ compressed stream data by sequentially compressing the first to $N^{th}$ stream data with a variable length compression, divides the first to $N^{th}$ compressed stream data into fixed-length blocks, and sequentially transmits the fixed-length blocks to the display driver. The display driver includes a memory storing therein the fixed-length blocks and a decompression circuitry reading out the fixed-length blocks from the memory. The decompression circuitry includes first to $N^{th}$ processing circuits. The first to $N^{th}$ processing circuits each perform a predetermined process on the fixed-length blocks received to generate processed data. The host device sorts the fixed-length blocks so that the fixed-length blocks are supplied in the order in which the first to $N^{th}$ processing circuits require the fixed-length blocks.

21 Claims, 17 Drawing Sheets

Related U.S. Application Data

(60) Provisional application No. 62/462,586, filed on Feb. 23, 2017.

(51) Int. Cl.
*G09G 3/20* (2006.01)
*G09G 3/3275* (2016.01)
*G09G 5/395* (2006.01)

(52) U.S. Cl.
CPC ..... *G09G 3/3291* (2013.01); *G09G 5/395* (2013.01); *G09G 2300/0439* (2013.01); *G09G 2310/027* (2013.01); *G09G 2320/0271* (2013.01); *G09G 2320/0285* (2013.01); *G09G 2320/0626* (2013.01); *G09G 2330/028* (2013.01); *G09G 2340/02* (2013.01); *G09G 2350/00* (2013.01)

(56) References Cited

U.S. PATENT DOCUMENTS

| | | | | |
|---|---|---|---|---|
| 9,503,122 | B1 * | 11/2016 | Henry | H03M 7/42 |
| 9,509,336 | B1 * | 11/2016 | Henry | H03M 7/40 |
| 10,176,761 | B2 * | 1/2019 | Furihata | G09G 3/3258 |
| 2003/0009596 | A1 * | 1/2003 | Tonomura | G06F 7/24 709/247 |
| 2009/0027410 | A1 | 1/2009 | Inuzuka | |
| 2010/0080473 | A1 * | 4/2010 | Han | H04N 19/62 382/233 |
| 2012/0044216 | A1 * | 2/2012 | Furihata | G09G 3/3688 345/204 |
| 2012/0120043 | A1 | 5/2012 | Cho et al. | |
| 2012/0189023 | A1 * | 7/2012 | Huang | H04L 1/0006 370/477 |
| 2014/0022221 | A1 | 1/2014 | Furihata et al. | |
| 2014/0104249 | A1 * | 4/2014 | Furihata | G09G 3/3674 345/204 |
| 2014/0146098 | A1 * | 5/2014 | Furihata | G09G 5/00 345/694 |
| 2016/0301950 | A1 | 10/2016 | Jacobson et al. | |
| 2018/0082160 | A1 * | 3/2018 | Nakane | G06K 15/1851 |
| 2019/0268022 | A1 * | 8/2019 | Xu | H04B 17/336 |

* cited by examiner

Fig. 1

| SYMBOL | HUFFMAN CODE | NUMBER OF BITS |
|---|---|---|
| 0 | 0 | 1 |
| 1 | 10 | 2 |
| -1 | 110 | 3 |
| 2 | 1110 | 4 |
| -2 | 11110 | 5 |
| OTHERS (-127～127) | 11111xxxxxxx | 13 |

COMPRESSED DATA TRANSMISSION IN PANEL DISPLAY SYSTEM

CROSS-REFERENCE TO RELATED APPLICATIONS

This application claims the benefit of U.S. patent application Ser. No. 15/594,327 filed May 12, 2017 entitled "COMPRESSED DATA TRANSMISSION IN PANEL DISPLAY SYSTEM", which claims the benefit of U.S. provisional patent application Ser. No. 62/462,586, filed Feb. 23, 2017 entitled "MURA CORRECTION TABLES COMPRESSION", which is incorporated by reference in its entirety.

TECHNICAL FIELD

The present invention relates to a display system, a host device and a non-transitory storage medium, more particularly, transfer of compressed data in a panel display system including a display panel.

BACKGROUND ART

In a panel display system including a display panel, data associated with respective subpixels of respective pixels of the display panel are transmitted to a display driver which drives the display panel. Such data may include, for example, image data specifying the grayscale values of the respective subpixels of the respective pixels and correction data associated with the respective subpixels of the respective pixels. The correction data referred herein is data used in a correction calculation of image data to improve the image quality. Recently, the number of pixels of a display panel to be driven by a display driver is increased, and this causes an increase in the amount of data to be supplied to the display driver. The increase in the data to be supplied to a display driver may cause increases in the baud rate and power consumption which are required for the data transfer to the display driver.

One approach to address the increase of data to be supplied to a display driver is to generate compressed data by performing data compression on original data to be transmitted to the display drier, and to supply the compressed data to the display driver. In this case, decompressed data corresponding to the original data is generated by decompressing the compressed data in the display driver and the display driver is operated in response to the decompressed data. This operation allows supplying an increased amount of data to a display driver in a short period of time.

In a panel display system configured to transmit compressed data to a display driver, however, restrictions of hardware of the display driver may cause an issue. First of all, a display driver, which handles an increased amount of compressed data, is required to rapidly decompress the compressed data. When the compressed data is decompressed with a hardware circuit in the display driver, on the other hand, there is a limitation in the allowed amount of compressed data for which decompression processing is performed in each clock cycle. This is because a high breakdown voltage process is used to manufacture a display driver to achieve high-voltage operation. In general, the operation speed of a device manufactured with a high breakdown voltage process is not so high. This may become a restriction against rapidly decompressing compressed data in a display driver.

This problem is especially significant when variable length compression is used in the data compression. When a compressed data compressed through a variable length compression is decompressed, a bit search is perform to identify the end of each code and the value of each code; however, a display driver suffers from a limitation of the number of bits for which the bit search can be performed in each clock cycle. This may become a restriction against rapidly decompressing the compressed data generated through a variable length compression. The limitation of the number of bits for which the bit search can be performed is significant especially when a long code length is allowed in the variable length compression.

Accordingly, there is a technical need for rapidly decompressing compressed data in a display driver in a panel display system configured to transmit compressed data to a display driver.

It should be noted that Japanese Patent Application Publication No. 2011-150536 discloses a technique for achieving variable-length coding (run-length coding and Huffman coding) through parallel processing by using a reconfigurable circuit.

Japanese Patent Application Publication No. H06-237448 discloses a coding apparatus which performs coding of quantization/DCT coefficients by using two-dimension Huffman table reference sections provided in parallel and a technique for decoding an image coded by the coding apparatus by using two-dimension Huffman table reference sections provided in parallel.

Japanese Patent Application Publication No. H04-177916 discloses an image data coding circuit which performs coding of still picture data using a DCT circuit, a quantization circuit, a differential circuit, a run-length coding circuit and a Huffman coding circuit.

Japanese Patent Application Publication No. 2007-279290 discloses a display device which displays an image through controlling a display of each pixel in response to an image data associated with each pixel. The display device includes a correction memory storing data for correcting variations in the brightness of the respective pixels and a correcting means which performs correction of brightness mura by performing an operation on input data with the data stored in the correction memory, and the display device is configured to store correction data generated through entropy coding in the correction memory and perform the operation on the input data while decompressing the data in the correcting means. Huffman coding is used as the entropy coding and the correction memory has different Huffman tables for the respective sub-areas.

SUMMARY OF INVENTION

Therefore, an objective of the present disclosure is to provide a technique for rapidly decompressing compressed data in a display driver in a panel display system configured to transmit compressed data to the display driver. Other objectives and new features of the present disclosure would be understood by a person skilled in the art from the following description.

In one embodiment of the present disclosure, a display system includes a display panel, a host device and a display driver driving the display panel. The host device is configured to divide original data respectively associated with subpixels of pixels of the display panel into first to $N^{th}$ stream data for N being an integer of two or more, generate first to $N^{th}$ compressed stream data by compressing the first to $N^{th}$ stream data through a variable length compression, respectively, individually divide each of the first to $N^{th}$ compressed stream data into fixed-length blocks, sort the fixed-length blocks, and sequentially transmit the sorted fixed-length blocks to the display driver. The display driver includes a memory storing the fixed-length blocks sequentially received from the host device, a decompression circuitry reading out the fixed-length blocks from the memory and generating decompressed data by performing a decompression process on the fixed-length blocks read out to generate decompressed data, and a drive circuitry driving the subpixels of the pixels of the display panel in response to the decompressed data. The decompression circuitry includes: first to $N^{th}$ processing circuits; and a state controller which reads out the fixed-length blocks from the memory in response to requests from the first to $N^{th}$ processing circuits and delivers the fixed-length blocks to the first to $N^{th}$ processing circuits. The first to $N^{th}$ processing circuits each perform a predetermined process on the fixed-length blocks received from the state controller to generate processed data. The decompressed data include the processed data output from the first to $N^{th}$ processing circuits. The host device is configured to sort the fixed-length blocks so that the fixed-length blocks are supplied to the memory in an order in which the first to $N^{th}$ processing circuits require the fixed-length blocks to the state controller.

In another embodiment of the present disclosure, a host device to be used in a display system including a display driver driving a display panel is provided. The host device includes a storage device which stores compression software and a processor which executes the compression software. The processor is programmed with the compression software to divide original data respectively associated with subpixels of pixels of the display panel into first to $N^{th}$ stream data for N being an integer of two or more, generate first to $N^{th}$ compressed stream data by compressing the first to $N^{th}$ stream data through a variable length compression, respectively, store the first to $N^{th}$ compressed stream data into the storage device, individually divide each of the first to $N^{th}$ compressed stream data into fixed-length blocks, sort the fixed-length blocks, and sequentially transmit the sorted fixed-length blocks to the display driver. The display driver includes a memory storing the fixed-length blocks sequentially received from the host device, a decompression circuitry reading out the fixed-length blocks from the memory and generating decompressed data by performing a decompression process on the fixed-length blocks read out to generate decompressed data, and a drive circuitry driving the subpixels of the pixels of the display panel in response to the decompressed data. The decompression circuitry includes first to $N^{th}$ processing circuits; and a state controller reading out the fixed-length blocks from the memory in response to requests from the first to $N^{th}$ processing circuits and delivering the fixed-length blocks to the first to $N^{th}$ processing circuit. The first to $N^{th}$ processing circuits each perform a predetermined process on the fixed-length blocks received from the state controller to generate processed data, and the decompressed data include the processed data output from the first to $N^{th}$ processing circuits. The processor is programmed with the compression software to sort the fixed-length blocks so that the fixed-length blocks are supplied to the memory in an order in which the first to $N^{th}$ processing circuits require the fixed-length blocks to the state controller.

The above-described operation of the host device may be achieved by executing a program stored in a non-transitory storage medium by a processor.

The present disclosure provides a technique for rapidly decompressing compressed data in a display driver in a panel display system configured to transmit the compressed data to the display driver.

BRIEF DESCRIPTION OF THE DRAWINGS

The above and other advantages and features of the present invention will be more apparent from the following description taken in conjunction with the accompanied drawings, in which:

FIG. 1 illustrates an example of a code allocation in Huffman coding;

DETAILED DESCRIPTION OF PREFERRED EMBODIMENTS

In the following, embodiments of the present disclosure will be described with reference to the attached drawings.

In the following, for easiness of understanding of the present disclosure, a discussion is first given of a problem of hardware-related restrictions of a display driver in a panel display system configured to transmit compressed data to the display driver.

As described above, a display driver, which may handle a large amount of compressed data, is required to rapidly decompress compressed data. In decompressing compressed data with a hardware circuit in the display driver, on the other hand, there is a limitation in the allowed amount of compressed data for which the decompression process is performed in each clock cycle. This problem is significant especially when variable length compression is used for the data compression. In the following, a discussion is given of the case when data compression is achieved through variable length compression, more particularly, Huffman coding.

FIG. 1 illustrates an example of a code allocation in Huffman coding. In the example of FIG. 1, each symbol is a data associated with each subpixel, for example, a correction data or an image data. In the code allocation illustrated in FIG. 1, each symbol is defined as a signed eight-bit data, taking a value from −127 to 127. A Huffman code is defined for each symbol. The code lengths of Huffman codes are variable; in the example illustrated in FIG. 1, the code lengths of the Huffman codes range from one to 13 bits.

Figure 2:
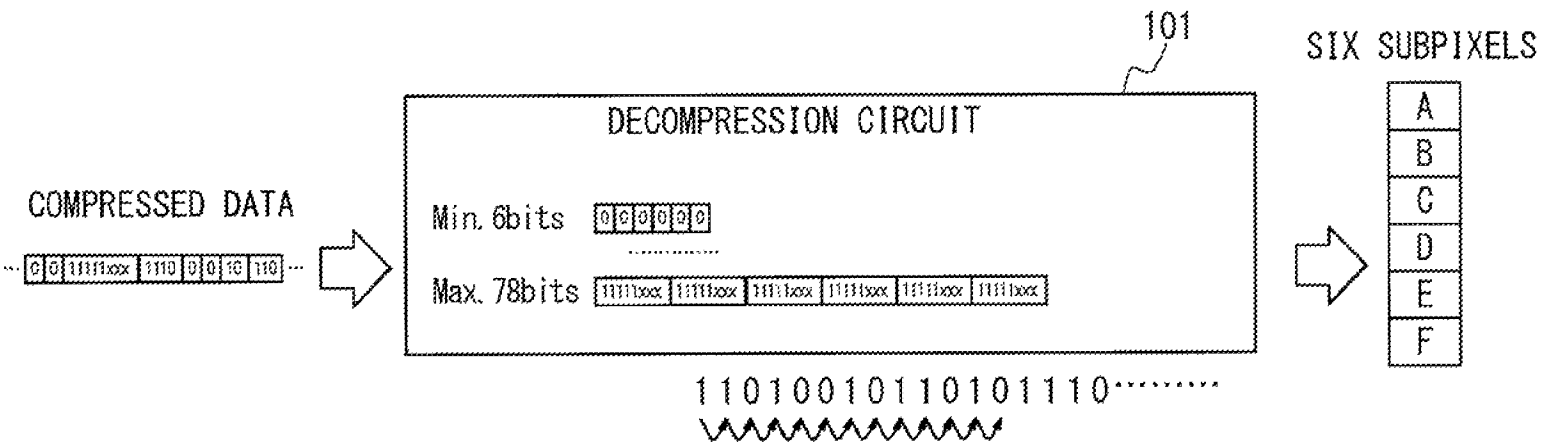
FIG. 2 illustrates an example of a decompression process of compressed data generated through Huffman coding based on the code allocation illustrated in FIG. 1.

FIG. 2 illustrates an example of the decompression process of compressed data generated through the Huffman coding based on the code allocation illustrated in FIG. 1. In the example illustrated in FIG. 2, compressed data associated with six subpixels are decompressed by a decompression circuit 101. The allowed minimum number of bits of compression data associated with six subpixels is six and the allowed maximum number of bits is 78. Therefore, when the compressed data thus configured are decompressed, this requires a bit search of a maximum of 78 bits. This implies that decompressing compressed data in units of six subpixels requires a processing circuit which operates at a very high speed.

One possible approach to improve the processing speed of compressed data is parallelization. The effective processing speed is improved by preparing a plurality of decompression circuits in the display driver and performing decompression processes by the plurality of decompression circuits in parallel.

Use of the architecture in which decompression processes are performed simply in parallel, however, requires enhanced specifications for a memory which stores compression data in the display driver. Since chip size shrinkage is strongly required for a display driver, it is preferable that a display driver uses a memory with a single configuration and easy access control, for example, a memory configured to output data in the order of data reception, such as an FIFO. It is not preferable that a display driver uses a memory adapted to random access or a memory adapted to concurrent accesses to multiple addresses. It is not preferable either that a display driver uses a memory including a plurality of memory blocks which are individually accessible.

Figure 3:
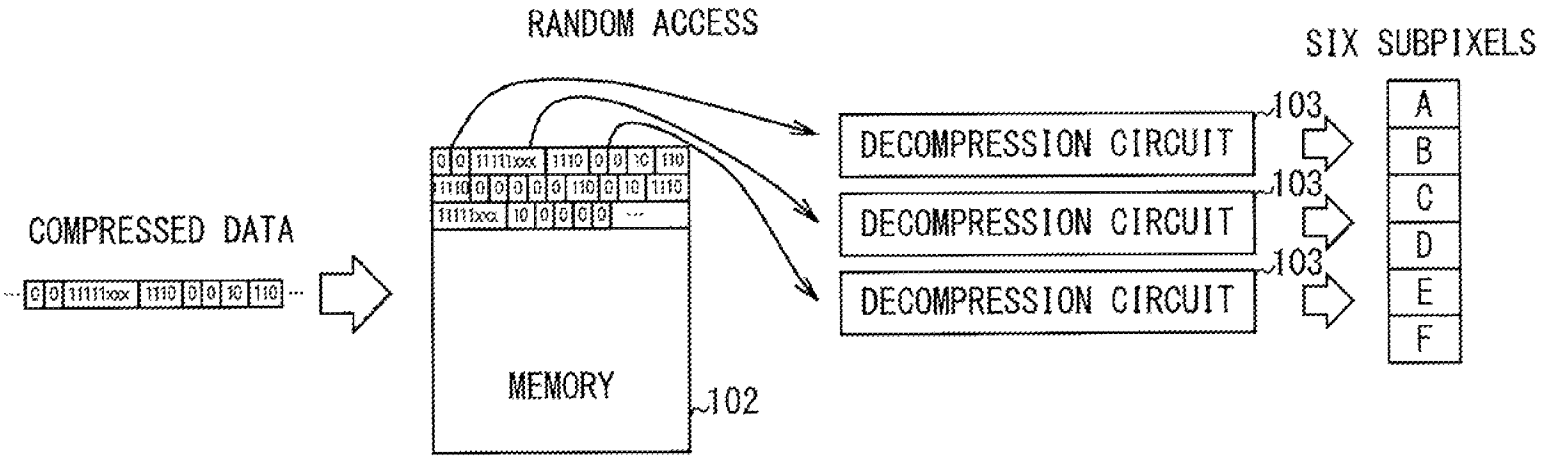
FIG. 3 is a block diagram illustrating one example of an architecture in which decompression processes are performed in parallel.

For example, a discussion is first given of the case when compressed data is delivered from a single memory 102 to a plurality of decompression circuits 103 as illustrated in FIG. 3. When compressed data generated through variable length compression is delivered to the plurality of decompression circuits 103, the respective decompression circuits 103 inevitably require transmission of compressed data at individual timing, because the lengths of codes included in the compressed data delivered to the respective decompression circuits 103 may be different. Such configuration requires the memory to be adapted to random accesses or to concurrent accesses to multiple addresses.

Figure 4:
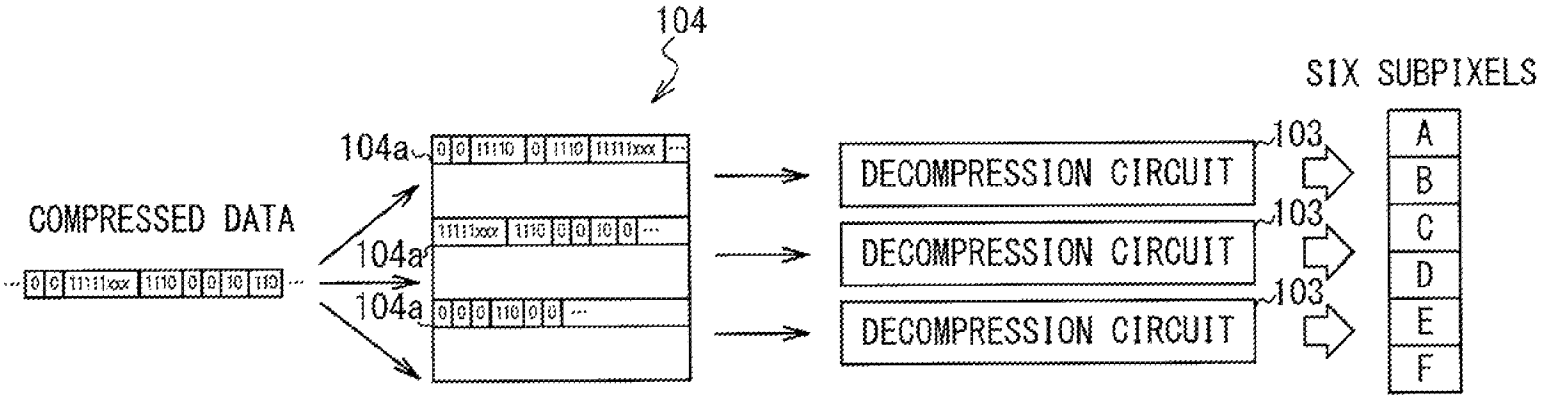
FIG. 4 is a block diagram illustrating another example of an architecture in which decompression processes are performed in parallel.

In another possible architecture, as illustrated in FIG. 4, a memory 104 including a plurality of individually accessible memory blocks 104*a* is prepared and memory blocks 104*a* are respectively allocated to the plurality of decompression circuits 103. This configuration, however, undesirably complicates the circuit configuration of the memory 104. Additionally, in the architecture provided with the memory 104 including the plurality of memory blocks 104*a*, once one of the memory blocks 104*a* becomes full of compressed data, compressed data cannot be further supplied to the memory 104. This undesirably deteriorates the efficiency of transmission of the compressed data to the memory 104.

Embodiments described below are basically directed to enhancement of the speed of the decompression process performed in a display driver through parallelization. It should be noted however that, in the embodiments described below, an approach designed by the inventors is used to generate compressed data to allow using a memory with easy access control in a display driver. In the following, various embodiments of the present disclosure will be described.

First Embodiment

Figure 5:
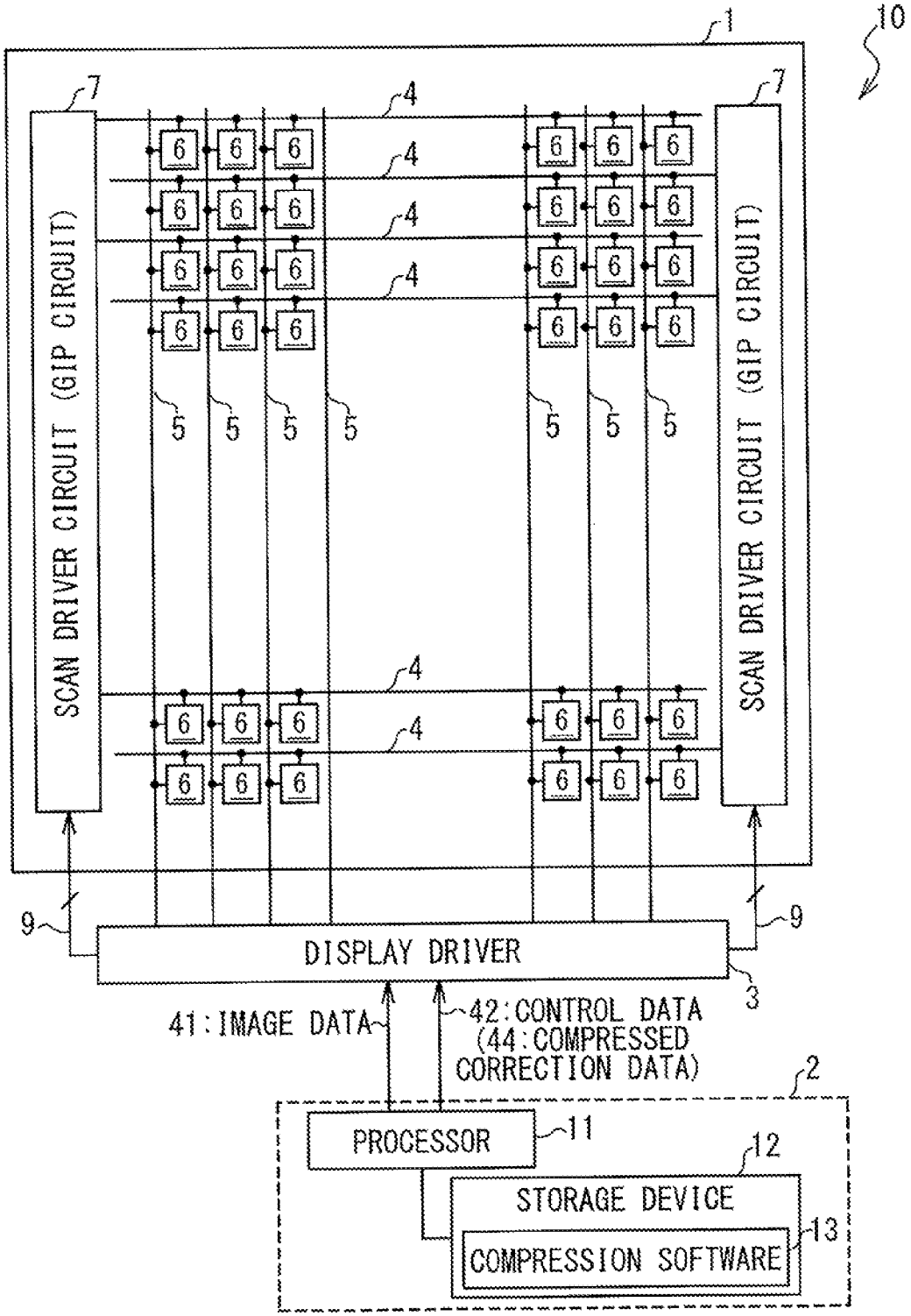
FIG. 5 is a block diagram illustrating the configuration of a display system in a first embodiment.

FIG. 5 is a block diagram illustrating the configuration of a display system 10 in a first embodiment. The display system 10 illustrated in FIG. 1 includes a display panel 1, a host device 2 and a display driver 3. An OLED (Organic Light Emitting Diode) display panel or a liquid crystal display panel may be used as the display panel 1, for example.

The display panel 1 includes scan lines 4, data lines 5, pixel circuits 6 and scan driver circuits 7. Each of the pixel circuits 6 is disposed at an intersection of a scan line 4 and a data line 5 and configured to display a selected one of the red, green and blue colors. The pixel circuits 6 displaying the red color are used as R subpixels. Similarly, the pixel circuits 6 displaying the green color are used as G subpixels, and the pixel circuits 6 displaying the blue color are used as B subpixels. When an OLED display panel is used as the display panel 1, the pixel circuits 6 displaying the red color include an OLED element emitting red colored light, the pixel circuits 6 displaying the green color include an OLED element emitting green colored light, and the pixel circuits 6 displaying the blue color include an OLED element emitting blue colored light. It should be noted that, when an OLED display panel is used as the display panel 1, other signal lines for operating the light emitting elements within the respective pixel circuits 6, such as emission lines used for controlling light emission of the light emitting elements of the respective pixel circuits 6, may be disposed.

Figure 6:
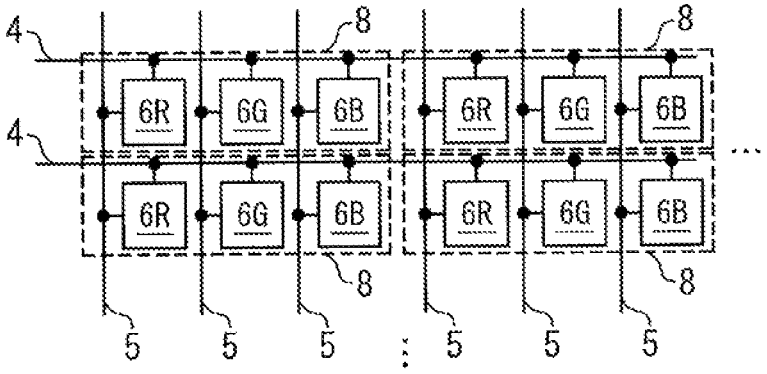
FIG. 6 illustrates the configuration of pixels of a display panel.

As illustrated in FIG. 6, each pixel 8 of the display panel 1 includes one R subpixel, one G subpixel and one B subpixel. In FIG. 6, the R subpixels (the pixel circuits 6 displaying the red color) are denoted by numeral "6R". Similarly, the G subpixels (the pixel circuits 6 displaying the green color) are denoted by numeral "6G" and the B subpixels (the pixel circuits 6 displaying the blue color) are denoted by numeral "6B".

Referring back to FIG. 5, the scan driver circuits 7 drive the scan lines 4 in response to scan control signals 9 received from the display driver 3. In the present embodiment, a pair of scan driver circuits 7 are provided; one of the scan driver circuits 7 drives the odd-numbered scan lines 4 and the other drives the even-numbered scan lines 4. In the present embodiment, the scan driver circuits 7 are integrated in the display panel 1 with a GIP (gate-in-panel) technology. The scan driver circuits 7 thus configured may be referred to as GIP circuits.

The host device 2 supplies image data 41 and control data 42 to the display driver 3. The image data describe the grayscale values of the respective subpixels (the R, G and B subpixels 6R, 6G and 6B) of the pixels 8 for displayed images. The control data 42 include commands and parameters used for controlling the display driver 3.

The host device 2 includes a processor 11 and a storage device 12. The processor 11 executes software installed on the storage device 12 to supply the image data 41 and the control data 42 to the display driver 3. In the present embodiment, the software installed on the storage device 12 includes compression software 13. An application processor, a CPU (central processing unit), a DSP (digital signal processor) or the like may be used as the processor 11.

In the present embodiment, the control data 42 supplied to the display driver 3 include compressed correction data. The compressed correction data is generated through compressing correction data prepared for the respective subpixels of the respective pixels 8 with the compression software 13. The compressed correction data is enclosed in fixed-length blocks (in the present embodiment, 96-bit blocks) and then supplied to the display driver 3.

Figure 7:
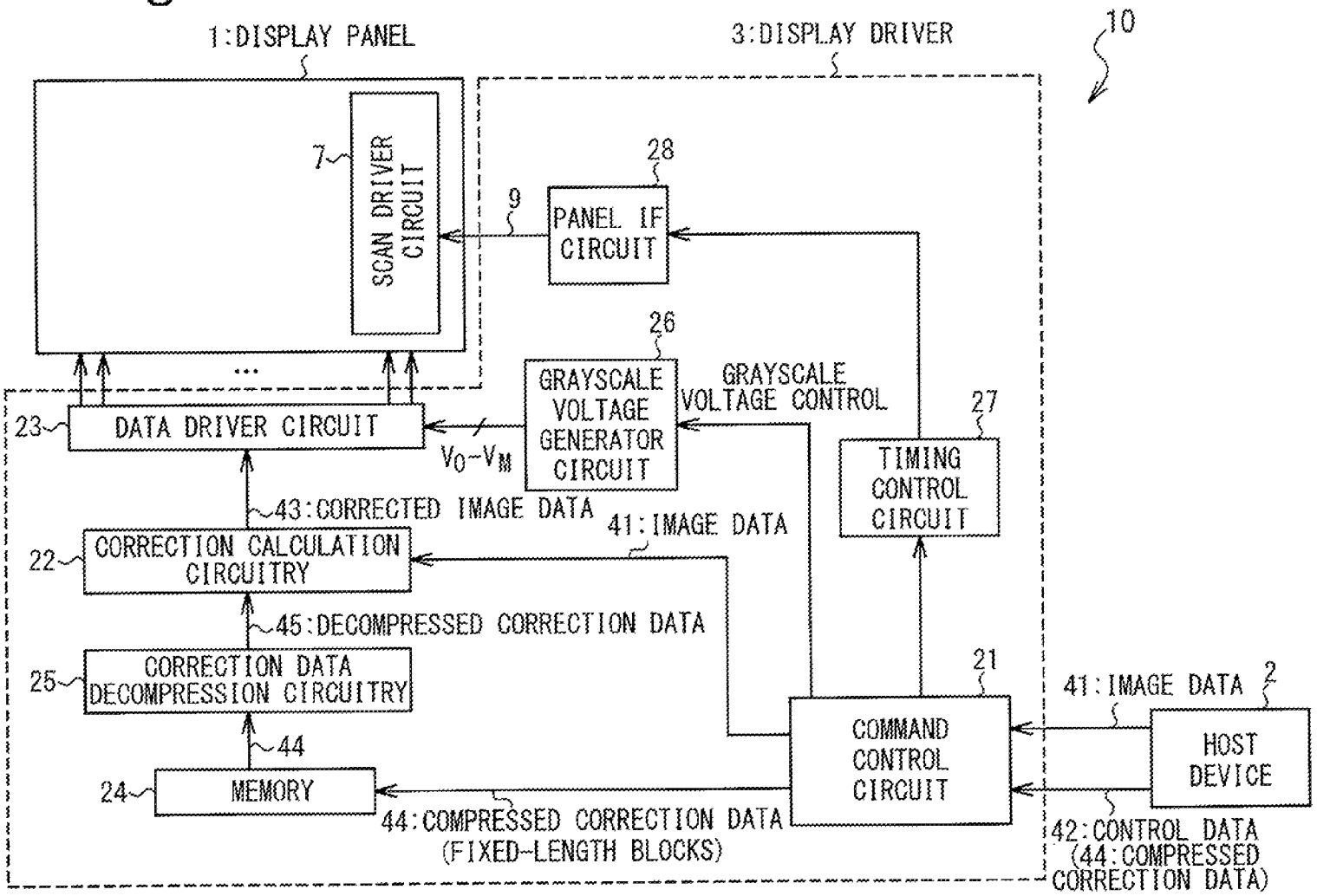
FIG. 7 is a block diagram illustrating the configuration of a display driver in the first embodiment.

The display driver 3 drives the display panel 1 in response to the image data 41 and control data 42 received from the host device 2, to display images on the display panel 1. FIG. 7 is a block diagram illustrating the configuration of the display driver 3 in the present embodiment.

The display driver 3 includes a command control circuit 21, a correction calculation circuitry 22, a data driver circuit 23, a memory 24, a correction data decompression circuitry 25, a grayscale voltage generator circuit 26, a timing control circuit 27 and a panel interface circuit 28.

The command control circuit 21 forwards the image data 41 received from the host device 2 to the correction calculation circuitry 22. Additionally, the command control circuit 21 controls the respective circuits of the display driver 3 in response to control parameters and commands included in the control data 42. It should be especially noted that, when the control data 42 include compressed correction data, the command control circuit 21 supplies the compressed correction data to the memory 24 to store the compressed correction data. In FIG. 7, the compressed correction data supplied from the command control circuit 21 to the memory 24 are denoted by numeral "44".

In the present embodiment, the host device 2 encloses the compressed correction data 44 in fixed-length blocks and sequentially supplies the fixed-length blocks to the command control circuit 21 of the display driver 3. The command control circuit 21 sequentially stores the fixed-length blocks into the memory 24. This results in that the compressed correction data 44 is stored in the memory 24 as the data of the fixed-length blocks.

The correction calculation circuitry 22 performs correction calculation on the image data 41 received from the command control circuit 21 to generate corrected image data 43 used to drive the display panel 1. In the present embodiment, the corrected image data 43 describe the grayscale values of the respective subpixels of the respective pixels 8.

The data driver circuit 23 operates as a drive circuitry which drives the respective data lines with the grayscale voltages corresponding to the grayscale values described in the corrected image data 43. In detail, the data driver circuit 23 selects, for the respective data lines 5, the grayscale voltages corresponding to the grayscale values described in the corrected image data 43 from among the grayscale voltages $V_0$ to $V_M$ supplied from the grayscale voltage generator circuit 26, and drives the respective data lines 5 to the selected grayscale voltages.

The memory 24 receives the compressed correction data 44 from the command control circuit 21 and stores therein the received compressed correction data 44. The compressed correction data 44 stored in the memory 24 is read out from the memory 24 as necessity and supplied to the correction data decompression circuitry 25.

As will be described later in detail, in the present embodiment, when sequentially receiving fixed-length blocks enclosing the compressed correction data 44, the memory 24 outputs the fixed-length blocks to the correction data decompression circuitry 25 in the order of reception. This operation facilitates the access control of the memory 24 and is effective for reducing the circuit size of the memory 24.

The correction data decompression circuitry 25 decompresses the correction data decompression circuitry read out from the memory 24 to generate decompressed correction data 45. The decompressed correction data 45, which is same as the original correction data prepared in the host device 2, is associated with the respective subpixels of the respective pixels 8. The decompressed correction data 45 is supplied to the correction calculation circuitry 22 and used for correction calculation in the correction calculation circuitry 22. The correction calculation performed with respect to an image data 41 associated with a certain subpixel (an R subpixel 6R, a G subpixel 6G or a B subpixel 6B) of a certain pixel 8 is performed in response to the decompressed correction data 45 associated with the certain subpixel of the certain pixel 8.

The grayscale voltage generator circuit 26 generates a set of grayscale voltages $V_0$ to $V_M$ respectively corresponding to the allowed values of the grayscale values described in the corrected image data 43. The generated grayscale voltages $V_0$ to $V_M$ are supplied to the data driver circuit 23 and used to drive the data lines 5 by the data driver circuit 23.

The timing control circuit 27 performs timing control of the respective circuits of the display driver 3 in response to control signals received from the command control circuit 21.

The panel interface circuit 28 supplies the scan control signals 9 to the scan driver circuits 7 of the display panel 1 to thereby control the scan driver circuits 7.

Figure 8:
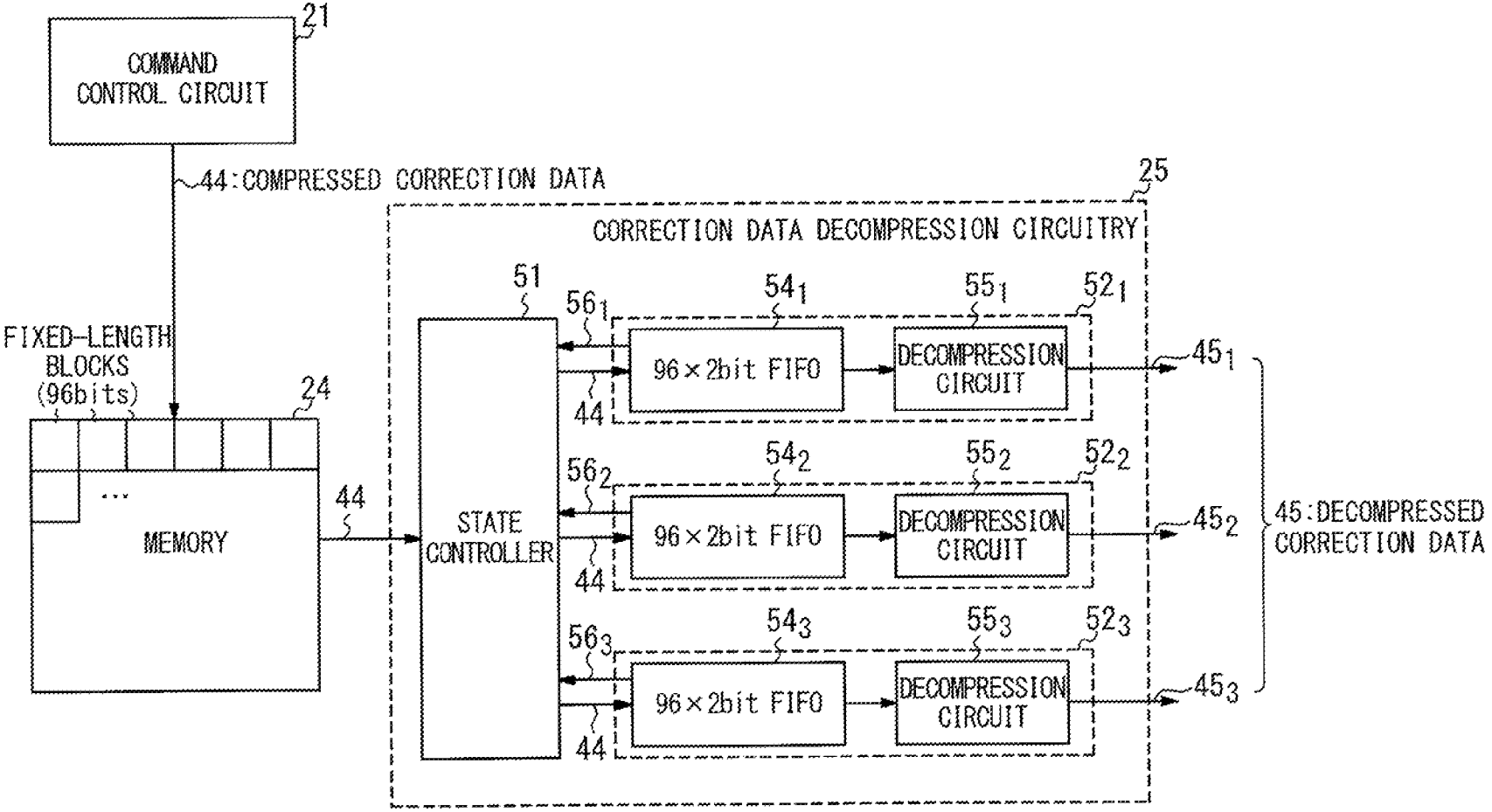
FIG. 8 is a block diagram illustrating the configuration of a correction data decompression circuitry in the first embodiment.

In the present embodiment, the correction data decompression circuitry 25 is configured to decompress the compressed correction data 44 through parallel processing to generate the decompressed correction data 45. FIG. 8 is a block diagram illustrating the configuration of the correction data decompression circuitry 25.

The correction data decompression circuitry 25 includes a state controller 51 and three processing circuits $\mathbf{52}_1$ to $\mathbf{52}_3$. The state controller 51 reads out the fixed-length blocks enclosing the compressed correction data 44 from the memory 24 and delivers the fixed-length blocks to the processing circuits $\mathbf{52}_1$ to $\mathbf{52}_3$. The processing circuits $\mathbf{52}_1$ to $\mathbf{52}_3$ performs a decompression process on the compressed correction data 44 enclosed in the received fixed-length blocks and generates decompressed correction data 45 corresponding to the original correction data.

In the present embodiment, the decompressed correction data 45 is generated through parallel processing using the plurality of processing circuits $\mathbf{52}_1$ to $\mathbf{52}_3$. The processing circuits $\mathbf{52}_1$ to $\mathbf{52}_3$ each performs a decompression process on the compressed correction data 44 enclosed in the fixed-length blocks received thereby and generate processed correction data $\mathbf{45}_1$ to $\mathbf{45}_3$, respectively. The decompressed correction data 45 is composed of the processed correction data $\mathbf{45}_1$ to $\mathbf{45}_3$ generated by the processing circuits $\mathbf{52}_1$ to $\mathbf{52}_3$.

The processing circuits $\mathbf{52}_1$, $\mathbf{52}_2$ and $\mathbf{52}_3$ is configured to supply request signals $\mathbf{56}_1$, $\mathbf{56}_2$ and $\mathbf{56}_3$ requesting transmission of fixed-length blocks enclosing compressed correction data 44, to the state controller 51. When the state controller 51 is requested to transmit a fixed-length block enclosing compressed correction data 44 by the request signal $\mathbf{56}_1$, the state controller 51 reads out the fixed-length block to be transmitted to the processing circuit $\mathbf{52}_1$ from the memory 24 and transmits the fixed-length block to the processing circuit $\mathbf{52}_1$. Similarly, when the state controller 51 is requested to transmit a fixed-length block by the request signal $\mathbf{56}_2$, the state controller 51 reads out the fixed-length block to be transmitted to the processing circuit $\mathbf{52}_2$ from the memory 24 and transmits the fixed-length block to the processing circuit $\mathbf{52}_2$. Furthermore, when the state controller 51 is requested to transmit a fixed-length block by the request signal $\mathbf{56}_3$, the state controller 51 reads out the fixed-length block to be transmitted to the processing circuit $\mathbf{52}_3$ from the memory 24 and transmits the fixed-length block to the processing circuit $\mathbf{52}_3$.

More specifically, the processing circuits $\mathbf{52}_1$ to $\mathbf{52}_3$ include FIFOs $\mathbf{54}_1$ to $\mathbf{54}_3$ and decompression circuits $\mathbf{55}_1$ to $\mathbf{55}_3$, respectively. The FIFOs $\mathbf{54}_1$ to $\mathbf{54}_3$ each have a capacity to store two fixed-length blocks. The FIFOs $\mathbf{54}_1$ to $\mathbf{54}_3$ temporarily stores therein fixed-length blocks delivered from the state controller 51. The FIFOs $\mathbf{54}_1$ to $\mathbf{54}_3$ are configured to temporarily store data supplied thereto and output the data in the order of reception. Additionally, the FIFOs $\mathbf{54}_1$ to $\mathbf{54}_3$ activate the request signals $\mathbf{56}_1$ to $\mathbf{56}_3$, respectively, to request transmission of compressed correction data 44, every when the FIFOs $\mathbf{54}_1$ to $\mathbf{54}_3$ output the compressed correction data 44 enclosed in one fixed-length block to the decompression circuits $\mathbf{55}_1$ to $\mathbf{55}_3$, respectively. The decompression circuits $\mathbf{55}_1$ to $\mathbf{55}_3$ receives fixed-length blocks enclosing compressed correction data 44 from the FIFOs $\mathbf{54}_1$ to $\mathbf{54}_3$, respectively, and decompress the compressed correction data 44 enclosed in the received fixed-length blocks to generate the processed correction data $\mathbf{45}_1$ to $\mathbf{45}_3$. The decompressed correction data 45 to be output from the correction data decompression circuitry 25 are composed of the processed correction data $\mathbf{45}_1$ to $\mathbf{45}_3$.

Next, a description is given of the operation of the display system 10 in the present embodiment. The overall operation of the display system 10 is as follows.

Before image displaying, compressed correction data 44 is supplied from the host device 2 to the display driver 3 and the supplied compressed correction data 44 is written into the memory 24. In detail, correction data is prepared in the host device 2 with respect to the respective subpixels of the respective pixels 8 of the display panel 1, and compressed correction data 44 is generated by compressing the correction data with the compression software 13. The compressed correction data is enclosed in fixed-length blocks (in the present embodiment, 96-bit blocks) and transmitted to the display driver 3 as a part of control data 42. The fixed-length blocks transmitted to the display driver 3 are written into the memory 24. The fixed-length blocks enclosing the compressed correction data 44 may be written immediately after a boot of the display system 10 or at appropriate timing after the display system 10 starts to operate.

When an image is displayed on the display panel 1, image data 41 corresponding to the image are supplied from the host device 2 to the display driver 3. The image data 41 supplied to the display driver 3 are supplied to the correction calculation circuitry 22.

In the meantime, the fixed-length blocks enclosing the compressed correction data 44 is read out from the memory 24 and supplied to the correction data decompression circuitry 25. The correction data decompression circuitry 25 decompresses the compressed correction data 44 enclosed in the supplied fixed-length blocks to generate the decompressed correction data 45. The decompressed correction data 45 is generated for the respective subpixels (the R subpixels 6R, G subpixels 6G and B subpixels 6B) of the pixels 8 of the display panel 1.

The correction calculation circuitry 22 corrects the image data 41 in response to the decompressed correction data 45 received from the correction data decompression circuitry 25 to generate corrected image data 43. In correcting the image data 41 associated with a certain subpixel of a certain pixel 8, the decompressed correction data 45 associated with the certain subpixel of the certain pixel 8 is used to thereby generate the corrected image data 43 associated with the certain subpixel of the certain pixel 8. The corrected image data thus generated is transmitted to the data driver circuit 23 and used to drive the respective subpixels of the respective pixels 8 of the display panel 1.

It should be noted that, in the present embodiment, when sequentially receiving fixed-length blocks enclosing compressed correction data 44, the memory operates to output the fixed-length blocks to the correction data decompression circuitry 25 in the order of reception. This operation is effective for facilitating the access control of the memory 24 and reducing the circuit size of the memory 24.

To achieve this operation, in the present embodiment, the scheme described in the following is used in generating the compressed correction data 44 in the host device 2.

Figure 9:
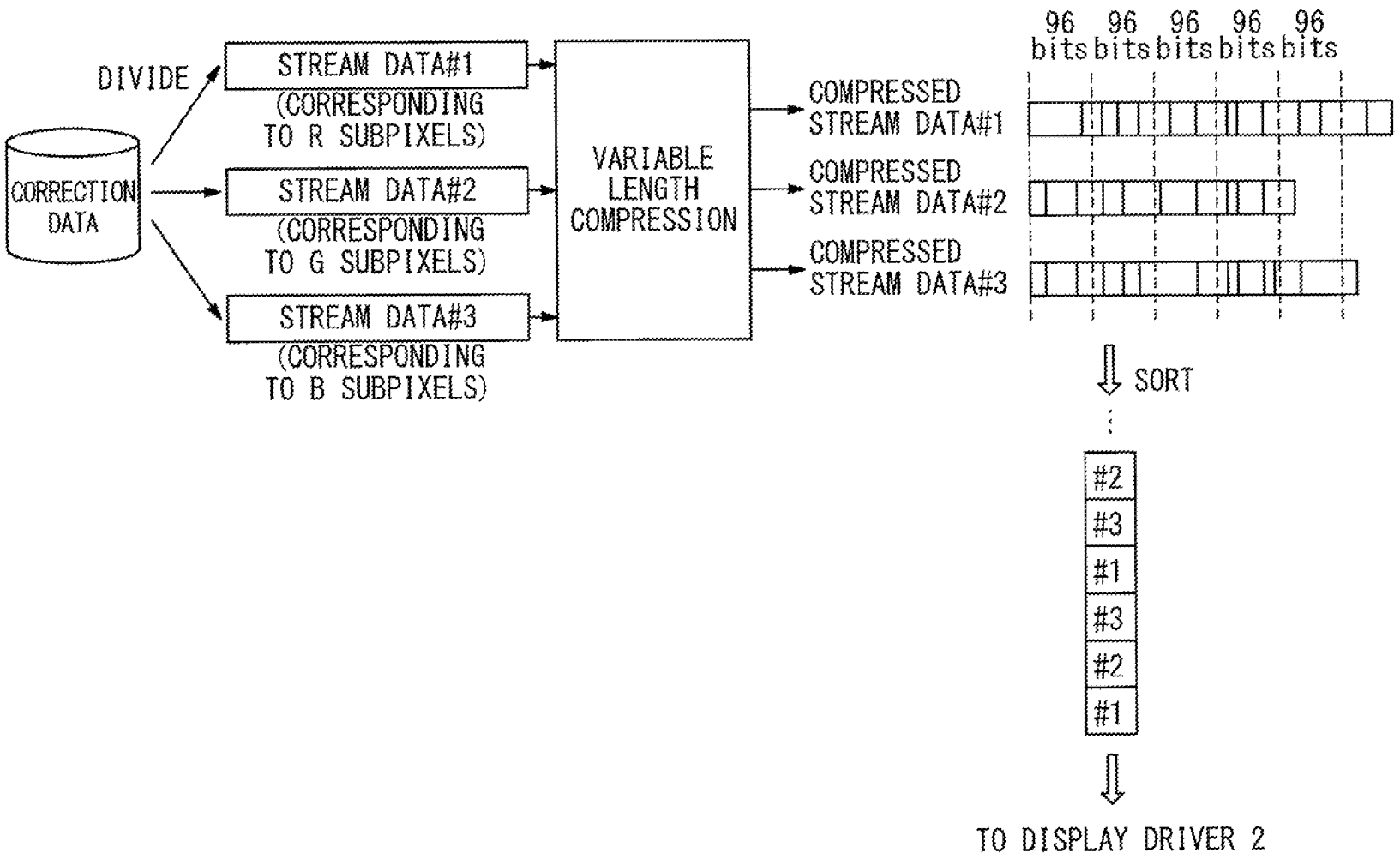
FIG. 9 is a diagram illustrating an operation of a host device to generate compressed correction data and transmit the compressed correction data to the display driver with the compressed correction data enclosed in fixed-length blocks.

FIG. 9 is a diagram illustrating the operation of the host device 2, which involves generating the compressed correction data 44 and transmitting the generated compressed correction data 44 to the display driver 3 with the compressed correction data 44 enclosed in fixed-length blocks. The operation illustrated in FIG. 9 is achieved by executing the compression software 13 by the processor 11 of the host device 2.

In the present embodiment, correction data is prepared in the host device 2 for the respective subpixels of the pixels 8 of the display panel 1. The correction data may be stored, for example, in the storage device 12.

The prepared correction data is divided into a plurality of stream data. The number of the stream data is equal to the number of the processing circuits $\mathbf{52}_1$ to $\mathbf{52}_3$, which perform the decompression process through parallel processing in the correction data decompression circuitry 25 of the display driver 3. In the present embodiment, the number of the processing circuits $\mathbf{52}_1$ to $\mathbf{52}_3$ is three and therefore the correction data is divided into stream data #1 to #3.In the present embodiment, in which the number of the stream data is three, the stream data may be generated by dividing the correction data on the basis of the associated colors of the subpixels. In this case, stream data #1 includes correction data associated with the R subpixels 6R of the respective pixels 8, stream data #2 includes correction data associated with the G subpixels 6G of the respective pixels 8, and stream data #3 includes correction data associated with the B subpixels 6B of the respective pixels 8. Stream data #1 to #3 thus generated are stored in the storage device 12 of the host device 2.

It should be noted that it is technically important that the plurality of stream data is respectively associated with the plurality of processing circuits 52; it is not important that the correction data is divided on the basis of the colors of the subpixels. When the number of the processing circuits 52 is four, for example, the correction data may be divided into four stream data respectively associated with the processing circuits 52.

The stream data #1 to #3 are individually compressed through variable length compression, to thereby generate compressed stream data #1 to #3. The compressed stream data #1 is generated by performing a variable length compression on the stream data #1. Similarly, the compressed stream data #2 is generated by performing a variable length compression on the stream data #2 and the compressed stream data #3 is generated by performing a variable length compression on the stream data #3.

Each of the compressed stream data #1 and #3 are individually divided into fixed-length blocks. In the present embodiment, each of the compressed stream data #1 and #3 is divided into 96-bit fixed-length blocks.

The fixed-length blocks obtained by dividing the compressed stream data #1 to #3 are sorted and transmitted to the display driver 3. In the present embodiment, the order into which the fixed-length blocks are sorted in the host device 2 is important for facilitating the access control of the memory 24. A description will be given later with respect to the order into which the fixed-length blocks are sorted in the host device 2. The sorted fixed-length blocks are sequentially transmitted to the display driver 3 and sequentially stored in the memory 24.

The compressed correction data 44 enclosed in the fixed-length blocks stored in the memory 24 are used when the correction calculation is performed on the image data 41. When a correction calculation is performed on the image data 41 of a certain subpixel of a certain pixel 8, the decompressed correction data 45 associated with the certain subpixel of the certain pixel 8 are generated in time for the correction calculation by decompressing the associated compressed correction data 44 by the correction data decompression circuitry 25.

Figure 10:
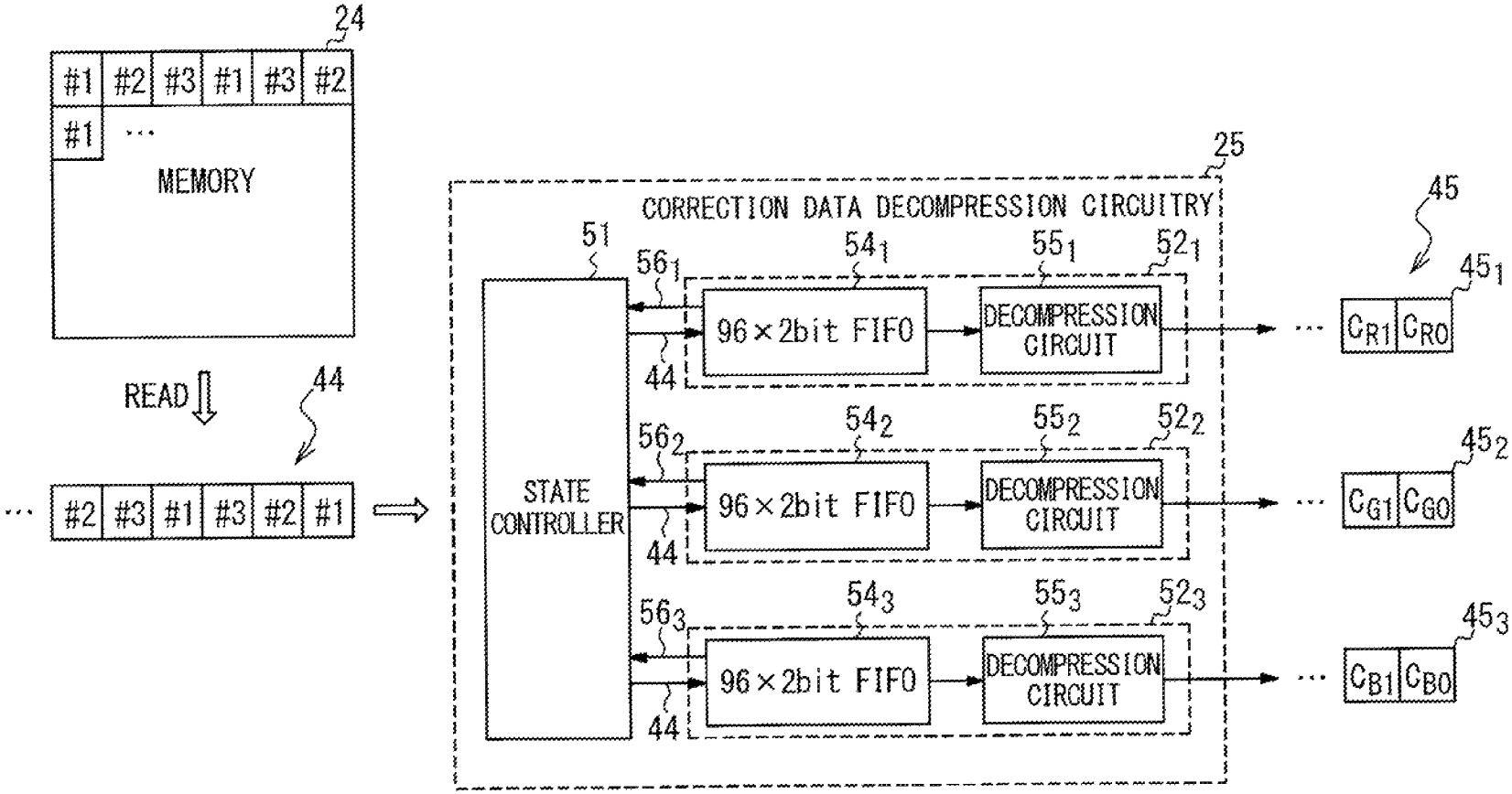
FIG. 10 is a diagram illustrating a decompression process performed in the correction data decompression circuitry in the first embodiment.

FIG. 10 is a diagram illustrating the decompression process performed in the correction data decompression circuitry 25. The state controller 51 reads out the fixed-length blocks enclosing the compressed correction data 44 from the memory 24 and delivers the fixed-length blocks to the processing circuits $\mathbf{52}_1$ to $\mathbf{52}_3$ in response to the request signals $\mathbf{56}_1$ to $\mathbf{56}_3$ received from the processing circuits $\mathbf{52}_1$ to $\mathbf{52}_3$.

In detail, in the correction calculation performed in a specific frame period, six fixed-length blocks are first sequentially read out by the state controller 51 and the compressed correction data 44 of two fixed-length blocks are stored in each of the FIFOs $\mathbf{54}_1$ to $\mathbf{54}_3$ of the processing circuits $\mathbf{52}_1$ to $\mathbf{52}_3$.

Subsequently, the compressed correction data 44 is sequentially transmitted from the FIFOs $\mathbf{54}_1$ to $\mathbf{54}_3$ to the decompression circuits $\mathbf{55}_1$ to $\mathbf{55}_3$ in the processing circuits $\mathbf{52}_1$ to $\mathbf{52}_3$, and the decompression circuits $\mathbf{55}_1$ to $\mathbf{55}_3$ sequentially perform the decompression process on the compressed correction data 44 received from the FIFOs $\mathbf{54}_1$ to $\mathbf{54}_3$ to thereby generate processed correction data $\mathbf{45}_1$, $\mathbf{45}_2$ and $\mathbf{45}_3$, respectively. As described above, the decompressed correction data 45 is composed of the processed correction data $\mathbf{45}_1$, $\mathbf{45}_2$ and $\mathbf{45}_3$.

In the present embodiment, the processed correction data $\mathbf{45}_1$, $\mathbf{45}_2$ and $\mathbf{45}_3$ is reproductions of stream data #1, #2 and #3, respectively, that is, the correction data associated with the R subpixels 6R, the G subpixels 6G and the B subpixels 6B, in the present embodiment. In FIG. 10, the correction data associated with the R subpixels 6R is denoted by symbols $C_{R0}$, $C_{R1}$ . . . , the correction data associated with the G subpixels 6G is denoted by symbols $C_{G0}$, $C_{G1}$, . . . , and the correction data associated with the B subpixels 6B is denoted by symbols $C_{B0}$, $C_{B1}$ . . . . In the correction calculation circuitry 22, the image data 41 associated with the R subpixels 6R is corrected on the basis of the correction data $C_{R1}$ associated with the R subpixels 6R, the image data 41 associated with the G subpixels 6G is corrected on the basis of the correction data $C_{G1}$ associated with the G subpixels 6G, and the image data 41 associated with the B subpixels 6B is corrected on the basis of the correction data $C_{B1}$ associated with the B subpixels 6B.

In the operation described above, the FIFO $\mathbf{54}_1$ of the processing circuit $\mathbf{52}_1$ activates the request signal $\mathbf{56}_1$ every when transmitting compressed correction data 44 of one fixed-length block to the decompression circuit $\mathbf{55}_1$. When the request signal $\mathbf{56}_1$ is activated to request for read of a fixed-length block, the state controller 51 reads out one fixed-length block from the memory 24 and supplies the fixed-length block to the FIFO $\mathbf{54}_1$.

The same goes for the processing circuits $\mathbf{52}_2$ and $\mathbf{52}_3$. The FIFO $\mathbf{54}_2$ of the processing circuit $\mathbf{52}_2$ activates the request signal $\mathbf{56}_2$ every when transmitting compressed correction data 44 of one fixed-length block to the decompression circuit $\mathbf{55}_2$. When the request signal $\mathbf{56}_2$ is activated to request for read of a fixed-length block, the state controller 51 reads out one fixed-length block from the memory 24 and supplies the fixed-length block to the FIFO $\mathbf{54}_2$. Furthermore, the FIFO $\mathbf{54}_3$ of the processing circuit $\mathbf{52}_3$ activates the request signal $\mathbf{56}_3$ every when transmitting compressed correction data 44 of one fixed-length block to the decompression circuit $\mathbf{55}_3$. When the request signal $\mathbf{56}_3$ is activated to request for read of a fixed-length block, the state controller 51 reads out one fixed-length block from the memory 24 and supplies the fixed-length block to the FIFO $\mathbf{54}_3$.

One issue is that, since the compressed correction data 44 is compressed through variable length compression, the code lengths of the compressed correction data 44 transmitted from the FIFOs $\mathbf{54}_1$ to $\mathbf{54}_3$ to the decompression circuits $\mathbf{55}_1$ to $\mathbf{55}_3$ may be different from one another, even when the decompression circuits $\mathbf{55}_1$ to $\mathbf{55}_3$ generate the processed correction data $\mathbf{45}_1$ to $\mathbf{45}_3$ associated with the same number of subpixels per clock cycle. This implies that the order in which the FIFOs $\mathbf{54}_1$ to $\mathbf{54}_3$ require reading of fixed-length blocks to the state controller 51 is dependent on the code lengths of the compressed correction data 44 used in the decompression process in the decompression circuits $\mathbf{55}_1$ to $\mathbf{55}_3$.

To address such situations and thereby facilitate the access control of the memory 24, in the present embodiment, the host device 2 sorts the fixed-length blocks enclosing the compressed correction data 44 into the order in which the fixed-length blocks is required by the processing circuits $\mathbf{52}_1$ to $\mathbf{52}_3$ of the correction data decompression circuitry 25, and supplies the sorted fixed-length blocks to the display driver 3 to store the same into the memory 24.

Attention should be paid to the fact that the order in which the processing circuits $\mathbf{52}_1$ to $\mathbf{52}_3$ of the correction data decompression circuitry 25 require fixed-length blocks are determined in advance, since the contents of the decompression process performed by the processing circuits $\mathbf{52}_1$ to $\mathbf{52}_3$ are determined on the basis of the correction calculation performed in the correction calculation circuitry 22. This implies that the order into which the host device 2 should sort the fixed-length blocks enclosing the compressed correction data 44 can be known in advance. The host device 2 sorts the fixed-length blocks into the order in which the fixed-length blocks are required by the processing circuits $\mathbf{52}_1$ to $\mathbf{52}_3$ of the correction data decompression circuitry 25 and supplies the sorted fixed-length blocks to the display driver 3.

To correctly determine the order in which the processing circuits $\mathbf{52}_1$ to $\mathbf{52}_3$ require the supply of the fixed-length blocks, the host device 2 performs the same process as the process performed on the fixed-length blocks by the state controller 51 and the processing circuits $\mathbf{52}_1$ to $\mathbf{52}_3$ with software, before the host device 2 actually transmits the fixed-length blocks enclosing the compressed correction data 44 to the display driver 3. In other words, the host device 2 may determine the order into which the fixed-length blocks are to be sorted, by simulating the process performed on the fixed-length blocks by the state controller 51 and the processing circuits $\mathbf{52}_1$ to $\mathbf{52}_3$ with software. In this case, the compression software installed on the storage device 12 of the host device 2 may include a software module which simulates the process same as the process performed on the fixed-length blocks by the state controller 51 and the processing circuits $\mathbf{52}_1$ to $\mathbf{52}_3$.

As described above, in the display system 10 of the present embodiment, the host device 2 is configured to sort the fixed-length blocks enclosing the compressed correction data 44 into the order in which the fixed-length blocks are required by the processing circuits $\mathbf{52}_1$ to $\mathbf{52}_3$ of the correction data decompression circuitry 25, supply the sorted fixed-length blocks to the display driver 3 and store the same into the memory 24. This allows matching the order in which the state controller 51 reads out the fixed-length blocks from the memory 24 in response to the requests from the processing circuits $\mathbf{52}_1$ to $\mathbf{52}_3$ with the order in which the fixed-length blocks are stored in the memory 24. This operation is effective for facilitating the access control of the memory 24. For example, the operation of the present embodiment eliminates the need of performing random accesses to the memory 24. This is effective for reducing the circuit size of the memory 24.

Second Embodiment

Figure 11:
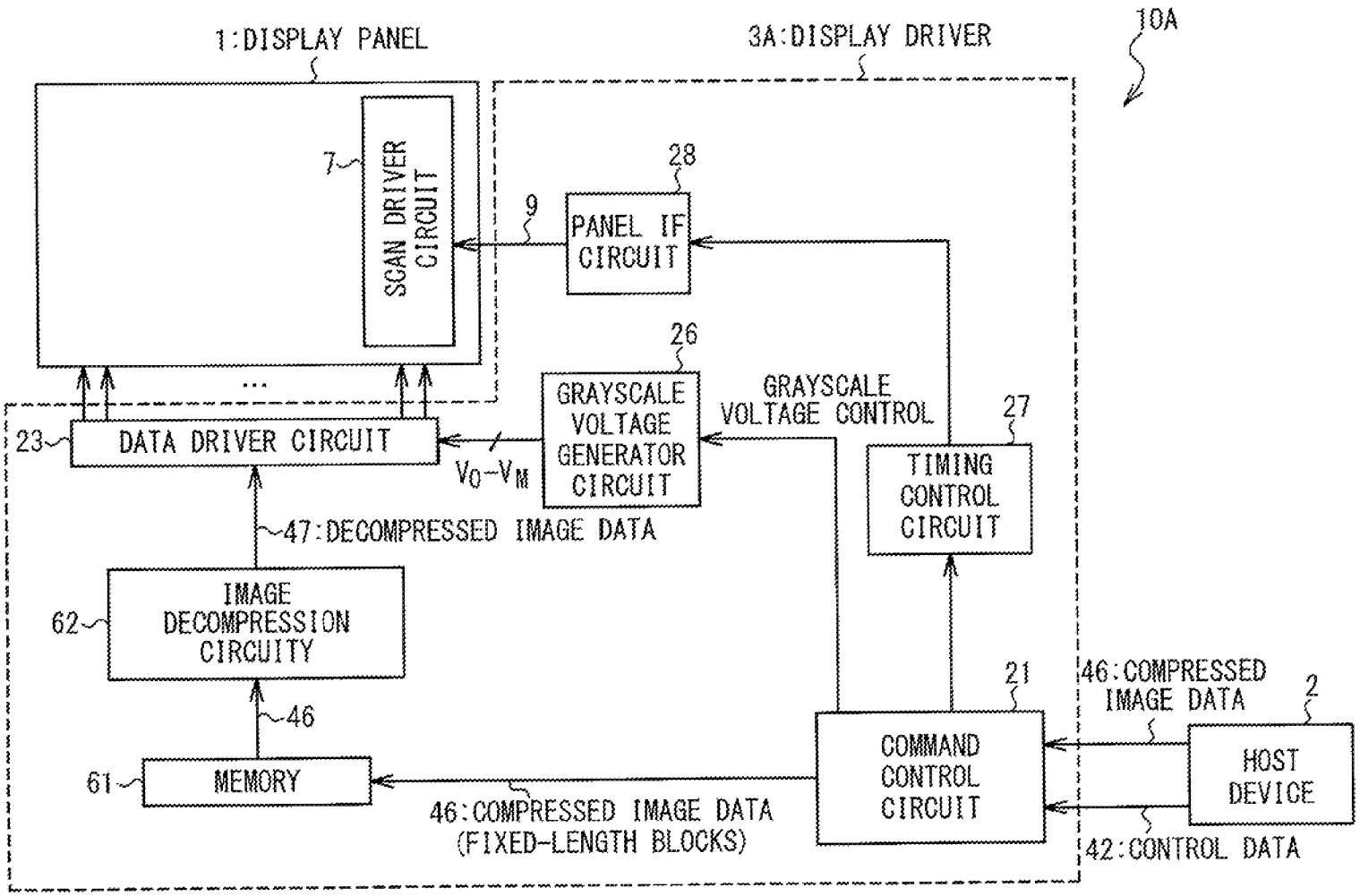
FIG. 11 is a block diagram illustrating the configuration of a display system in a second embodiment.

FIG. 11 is a block diagram illustrating the configuration of the display system 10A, more particularly, the configuration the display driver 3A in a second embodiment. The configuration of the display system 10A of the second embodiment is similar to that of the display system 10 of the first embodiment. In the second embodiment, however, a memory 61 and an image decompression circuitry 62 are provided in the display driver 3A in place of the memory 24 and the correction data decompression circuitry 25.

The display system 10A of the second embodiment is configured so that the host device 2 generates compressed image data 46 by compressing image data corresponding to an image to be displayed on the display panel 1 and supplies the compressed image data 46 to the display driver 3A. In the second embodiment, the compression process in which the host device 2 compresses the image data to generate the compressed image data 46 is the same as the compression process in which the host device 2 compresses the correction data to generate the compressed correction data 44 in the first embodiment, except for that the image data are compressed in place of the correction data. The compressed image data 46 is enclosed in fixed-length blocks and supplied to the display driver 3A. Details of the compression process to generate the compressed image data 46 will be described later in detail.

The display driver 3A is configured to receive the fixed-length blocks enclosing the compressed image data 46, store the received fixed-length blocks into the memory 61, supply the fixed-length blocks read out from the memory 61 to the image decompression circuitry 62 and perform a decompression process on the compressed image data 46 enclosed in the fixed-length blocks by the image decompression circuitry 62. Decompressed image data 47 generated by the decompression process by the image decompression circuitry 62 are supplied to the data driver circuit 23, and the data driver circuit 23 drives the respective data lines 5 with the grayscale voltages corresponding to the grayscale values described in the decompressed image data 47.

Figure 12:
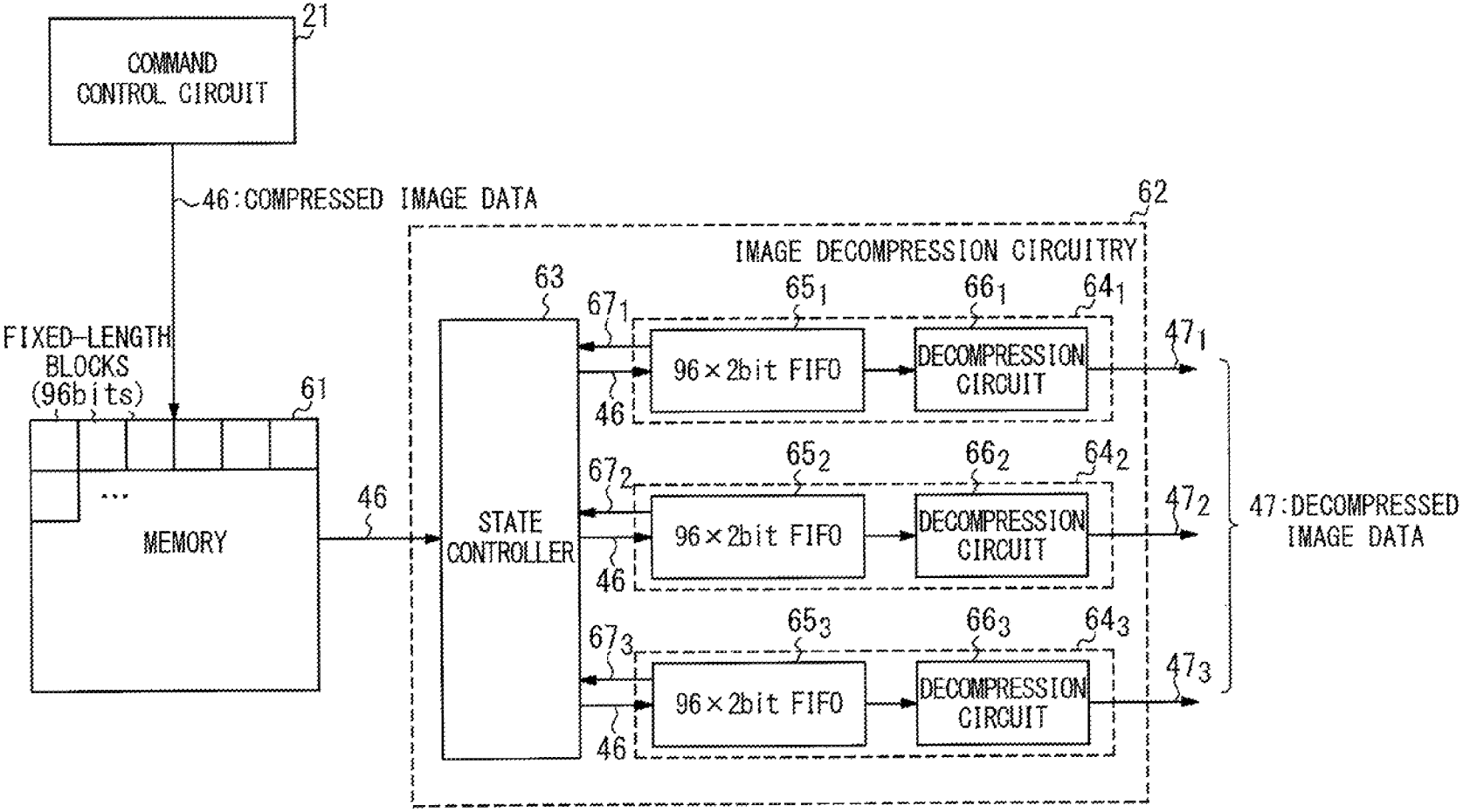
FIG. 12 is a block diagram illustrating the configuration of an image decompression circuitry in the second embodiment.

FIG. 12 is a block diagram illustrating the configuration of the image decompression circuitry 62. The image decompression circuitry 62 is configured to generate the decompressed image data 47 by decompressing the compressed image data 46 through parallel processing. The configuration of the image decompression circuitry 62 is similar to that of the correction data decompression circuitry 25 illustrated in FIG. 8, except for that the compressed image data 46 is supplied to the image decompression circuitry 62 in place of the compressed correction data 44.

In detail, the image decompression circuitry 62 includes a state controller 63 and three processing circuits $\mathbf{64}_1$ to $\mathbf{64}_3$. The state controller 63 reads out the fixed-length blocks enclosing the compressed image data 46 from the memory 61 and delivers the fixed-length blocks to the processing circuits $\mathbf{64}_1$ to $\mathbf{64}_3$. The processing circuits $\mathbf{64}_1$ to $\mathbf{64}_3$ sequentially perform the decompression process on the compressed image data 46 enclosed in the received fixed-length blocks to generate the decompressed image data 47 corresponding to the original image data.

In the present embodiment, the decompressed image data 47 is generated through parallel processing using the plurality of processing circuits $\mathbf{64}_1$ to $\mathbf{64}_3$. The processing circuits $\mathbf{64}_1$ to $\mathbf{64}_3$ each performs the decompression process on the compressed image data enclosed in the fixed-length blocks received thereby, to generate processed image data $\mathbf{47}_1$ to $\mathbf{47}_3$, respectively. The decompressed image data 47 is composed of the processed image data $\mathbf{47}_1$ to $\mathbf{47}_3$ generated by the processing circuits $\mathbf{64}_1$ to $\mathbf{64}_3$.

The processing circuits $\mathbf{64}_1$, $\mathbf{64}_2$ and $\mathbf{64}_3$ are configured to supply request signals $\mathbf{56}_1$, $\mathbf{56}_2$ and $\mathbf{56}_3$ requesting transmission of fixed-length blocks enclosing compressed image data 46, to the state controller 63. When the state controller 63 is requested to transmit a fixed-length block enclosing compressed image data 46 by the request signal $\mathbf{67}_1$, the state controller 63 reads out the fixed-length block to be transmitted to the processing circuit $\mathbf{64}_1$ and transmits the fixed-length block to the processing circuit $\mathbf{64}_1$. Similarly, when the state controller 63 is requested to transmit a fixed-length block by the request signal $\mathbf{67}_2$, the state controller 63 reads out the fixed-length block to be transmitted to the processing circuit $\mathbf{64}_2$ and transmits the fixed-length block to the processing circuit $\mathbf{64}_2$. Furthermore, when the state controller 63 is requested to transmit a fixed-length block by the request signal $\mathbf{67}_3$, the state controller 63 reads out the fixed-length block to be transmitted to the processing circuit $\mathbf{64}_3$ from the memory 61 and transmits the fixed-length block to the processing circuit $\mathbf{64}_3$.

More specifically, the processing circuits 641 to 643 include FIFOs $\mathbf{65}_1$ to $\mathbf{65}_3$ and decompression circuits $\mathbf{66}_1$ to $66_3$, respectively. The FIFOs $65_1$ to $65_3$ each have a capacity to store two fixed-length blocks. The FIFOs $65_1$ to $65_3$ temporarily stores therein fixed-length blocks delivered from the state controller 63. The FIFOs $65_1$ to $65_3$ are configured to temporarily store data supplied thereto and output the data in the order of reception. Additionally, the FIFOs $65_1$ to $65_3$ activate the request signals $67_1$ to $67_3$, respectively, to request transmission of compressed image data 46, every when the FIFOs $65_1$ to $65_3$ output the compressed image data 46 enclosed in one fixed-length block to the decompression circuits $66_1$ to $66_3$, respectively. The decompression circuits $66_1$ to $66_3$ receives fixed-length blocks enclosing compressed correction data 46 from the FIFOs $65_1$ to $65_3$, respectively, and decompress the compressed image data 46 enclosed in the received fixed-length blocks to generate the processed image data $47_1$ to $47_3$. The decompressed image data 47 to be output from the image decompression circuitry 62 are composed of the processed image data $47_1$ to $47_3$.

Figure 13:
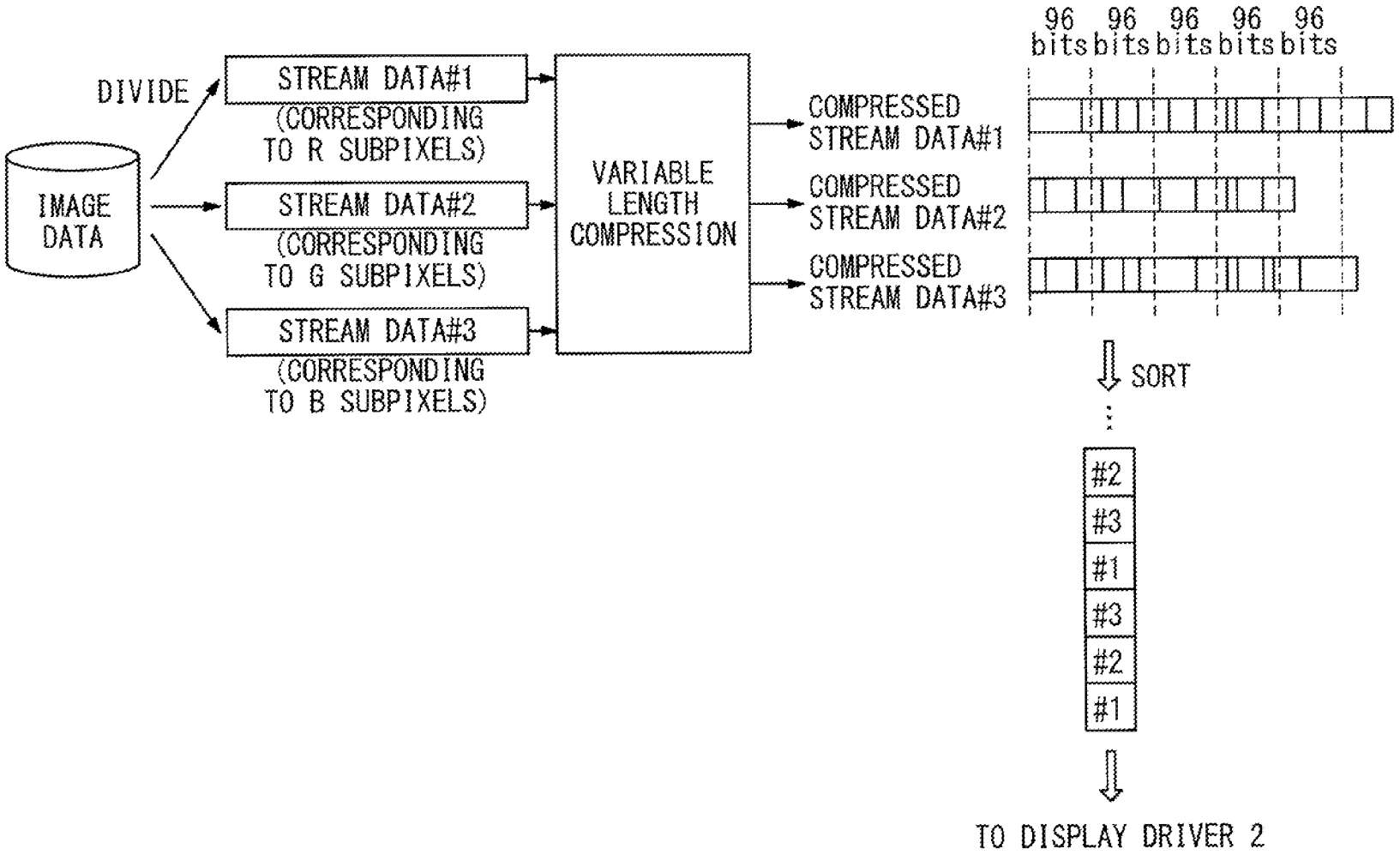
FIG. 13 is a diagram illustrating an operation of a host device to generate compressed image data and transmit the compressed image data to the display driver with the compressed image data enclosed in fixed-length blocks.

FIG. 13 is a diagram illustrating the operation of the host device 2, which involves generating the compressed image data 46 and transmitting the generated compressed image data 46 to the display driver 3A with the compressed image data 46 enclosed in fixed-length blocks. The operation illustrated in FIG. 13 is achieved by executing the compression software 13 by the processor 11 of the host device 2.

In the present embodiment, image data describing the grayscale values of the respective subpixels of the respective pixels 8 of the display panel are prepared in the host device 2. The image data may be stored, for example, in the storage device 12.

The prepared image data is divided into a plurality of stream data. The number of the stream data is equal to the number of the processing circuits $64_1$ to $64_3$, which perform the decompression process through parallel processing in the image decompression circuitry of the display driver 3A. In the present embodiment, the number of the processing circuits $64_1$ to $64_3$ is three and therefore the image data is divided into stream data #1 to #3. In the present embodiment, in which the number of the stream data is three, the stream data may be generated by dividing the image data on the basis of the associated colors of the subpixels. In this case, stream data #1 includes image data associated with the R subpixels 6R of the respective pixels 8, stream data #2 includes image data associated with the G subpixels 6G of the respective pixels 8, and stream data #3 includes image data associated with the B subpixels 6B of the respective pixels 8. Stream data #1 to #3 thus generated are stored in the storage device 12 of the host device 2.

It should be noted that it is technically important that the plurality of stream data is associated with the plurality of processing circuits 64, respectively; it is not important that the image data is divided on the basis of the colors of the subpixels. When the number of the processing circuits 64 is four, for example, the image data may be divided into four stream data respectively associated with the processing circuits 64.

The stream data #1 to #3 are individually compressed through variable length compression, to thereby generate compressed stream data #1 to #3. The compressed stream data #1 is generated by performing a variable length compression on the stream data #1. Similarly, the compressed stream data #2 is generated by performing a variable length compression on the stream data #2 and the compressed stream data #3 is generated by performing a variable length compression on the stream data #3.

Each of the compressed stream data #1 and #3 is individually divided into fixed-length blocks. In the present embodiment, each of the compressed stream data #1 and #3 is divided into 96-bit fixed-length blocks.

The fixed-length blocks obtained by dividing the compressed stream data #1 to #3 are sorted and transmitted to the display driver 3A. As is the case with the first embodiment, the order into which the fixed-length blocks are sorted in the host device 2 is important for facilitating the access control of the memory 61. In the present embodiment, the host device 2 sorts the fixed-length blocks enclosing the compressed image data 46 into the order in which the fixed-length blocks are required by the processing circuits $64_1$ to $64_3$ of the image decompression circuitry 62, and supplies the sorted fixed-length blocks to the display driver 3A to store the same into the memory 61.

Figure 14:
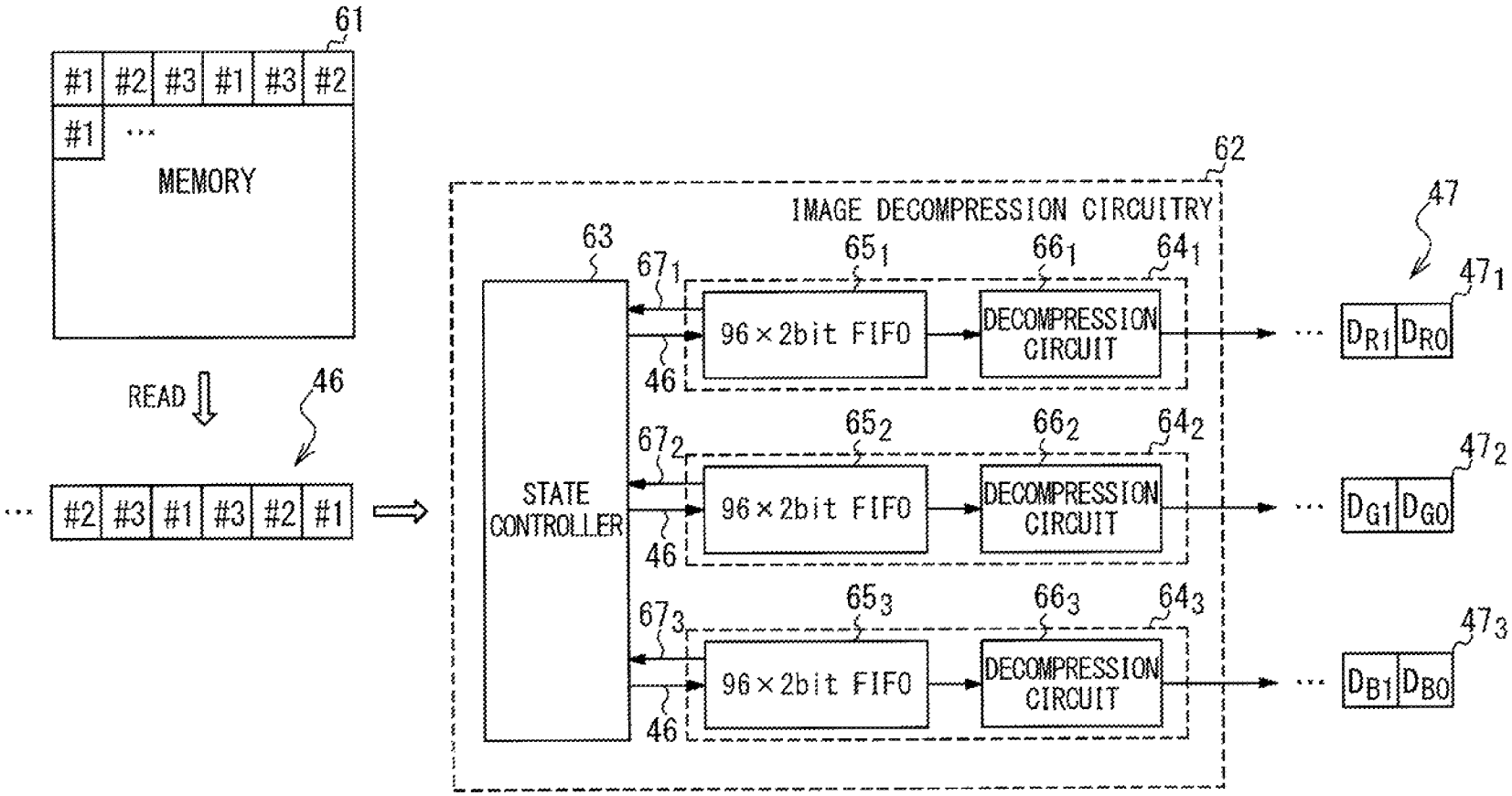
FIG. 14 is a diagram illustrating a decompression process performed in the image decompression circuitry in the second embodiment.

FIG. 14 is a diagram illustrating the decompression process performed in the image decompression circuitry 62. The state controller 63 reads out the fixed-length blocks enclosing the compressed image data 46 from the memory 24 and delivers the fixed-length blocks to the processing circuits $64_1$ to $64_3$ in response to the request signals $67_1$ to $67_3$ received from the processing circuits $64_1$ to $64_3$.

In detail, in the image display performed in a specific frame period, six fixed-length blocks are first sequentially read out by the state controller 63 and the compressed image data 46 of two fixed-length blocks are stored in each of the FIFOs $65_1$ to $65_3$ of the processing circuits $64_1$ to $64_3$.

Subsequently, the compressed image data 46 is sequentially transmitted from the FIFOs $65_1$ to $65_3$ to the decompression circuits $66_1$ to $66_3$ in the processing circuits $64_1$ to $64_3$, and the decompression circuits $66_1$ to $66_3$ sequentially perform the decompression process on the compressed image data 46 received from the FIFOs $65_1$ to $65_3$ to thereby generate processed image data $47_1$, $47_2$ and $47_3$, respectively. As described above, the decompressed image data 47 is composed of the processed image data $47_1$, $47_2$ and $47_3$.

In the present embodiment, the processed image data $47_1$, $47_2$ and $47_3$ are reproductions of stream data #1, #2 and #3, respectively, that is, the image data associated with the R subpixels 6R, the G subpixels 6G and the B subpixels 6B, in the present embodiment. In FIG. 14, the correction data associated with the R subpixels 6R is denoted by symbols $D_{R0}$, $D_{R1}$ . . . , the correction data associated with the G subpixels 6G is denoted by symbols $D_{G0}$, $D_{G1}$ . . . , and the correction data associated with the B subpixels 6B is denoted by symbols $D_{B0}$, $D_{B1}$ . . . . The R subpixels 6R of the display panel 1 are driven in response to the associated image data $D_{R1}$, the G subpixels 6G of the display panel 1 are driven in response to the associated image data $D_{G1}$, and the B subpixels 6B of the display panel 1 are driven in response to the associated image data $D_{B1}$.

In the operation described above, the FIFO $65_1$ of the processing circuit $64_1$ activates the request signal $67_1$ every when transmitting compressed image data 46 of one fixed-length block to the decompression circuit $66_1$. When the request signal $67_1$ is activated to request for read of a fixed-length block, the state controller 63 reads out one fixed-length block from the memory 61 and supplies the fixed-length block to the FIFO $65_1$.

The same goes for the processing circuits 642 and 643. The FIFO $65_2$ of the processing circuit $64_2$ activates the request signal $67_2$ every when transmitting compressed image data 46 of one fixed-length block to the decompression circuit $66_2$. When the request signal $67_2$ is activated to request for read of a fixed-length block, the state controller 63 reads out one fixed-length block from the memory 61 and supplies the fixed-length block to the FIFO $65_2$. Furthermore, the FIFO $65_3$ of the processing circuit $64_3$ activates the request signal $67_3$ every when transmitting compressed image data 46 of one fixed-length block to the decompression circuit $66_3$. When the request signal $67_3$ is activated to request for read of a fixed-length block, the state controller 63 reads out one fixed-length block from the memory 61 and supplies the fixed-length block to the FIFO $65_3$.

Since the compressed image data 46 is compressed through variable length compression, the code lengths of the compressed image data 46 transmitted from the FIFOs $65_1$ to $65_3$ to the decompression circuits $66_1$ to $66_3$ may be different from one another, even when the decompression circuits $66_1$ to $66_3$ generate the processed image data $47_1$ to $47_3$ associated with the same number of subpixels per clock cycle. This implies that the order in which the FIFOs $65_1$ to $65_3$ require reading of fixed-length blocks to the state controller 63 is dependent on the code lengths of the compressed image data 46 used in the decompression process in the decompression circuits $66_1$ to $66_3$.

To address such situations and thereby facilitate the access control of the memory 61, in the present embodiment, the host device 2 sorts the fixed-length blocks enclosing the compressed image data 46 into the order in which the fixed-length blocks is required by the processing circuits $64_1$ to $64_3$, and supplies the sorted fixed-length blocks to the display driver 3A to store the same into the memory 61.

It should be noted that the order in which the processing circuits $64_1$ to $64_3$ of the image decompression circuitry 62 require fixed-length blocks are determined in advance, since the contents of the decompression process performed by the processing circuits $64_1$ to $64_3$ are determined in advance. This implies that the order into which the host device 2 should sort the fixed-length blocks enclosing the compressed image data 46 can be known in advance. The host device 2 sorts the fixed-length blocks into the order in which the fixed-length blocks are required by the processing circuits $64_1$ to $64_3$ of the image decompression circuitry 62 and supplies the sorted fixed-length blocks to the display driver 3A.

To correctly determine the order in which the processing circuits $64_1$ to $64_3$ require the supply of the fixed-length blocks, the host device 2 performs the same process as the process performed on the fixed-length blocks by the state controller 63 and the processing circuits $64_1$ to $64_3$ with software, before the host device 2 actually transmits the fixed-length blocks enclosing the compressed image data 46 to the display driver 3A. In other words, the host device 2 may determine the order into which the fixed-length blocks are to be sorted, by simulating the process performed on the fixed-length blocks by the state controller 63 and the processing circuits $64_1$ to $64_3$ with software. In this case, the compression software installed on the storage device 12 of the host device 2 may include a software module which simulates the process same as the process performed on the fixed-length blocks by the state controller 63 and the processing circuits $64_1$ to $64_3$.

As described above, in the display system 10 of the present embodiment, the host device 2 is configured to sort the fixed-length blocks enclosing the compressed image data 46 into the order in which the fixed-length blocks are required by the processing circuits $64_1$ to $64_3$ of the image decompression circuitry 62, supply the sorted fixed-length blocks to the display driver 3A and store the same into the memory 61. This allows matching the order in which the state controller 63 reads out the fixed-length blocks from the memory 61 in response to the requests from the processing circuits $64_1$ to $64_3$ with the order in which the fixed-length blocks are stored in the memory 61. This operation is effective for facilitating the access control of the memory 61. For example, the operation of the present embodiment eliminates the need of performing random accesses to the memory 61. This is effective for reducing the circuit size of the memory 61.

Third Embodiment

Figure 15:
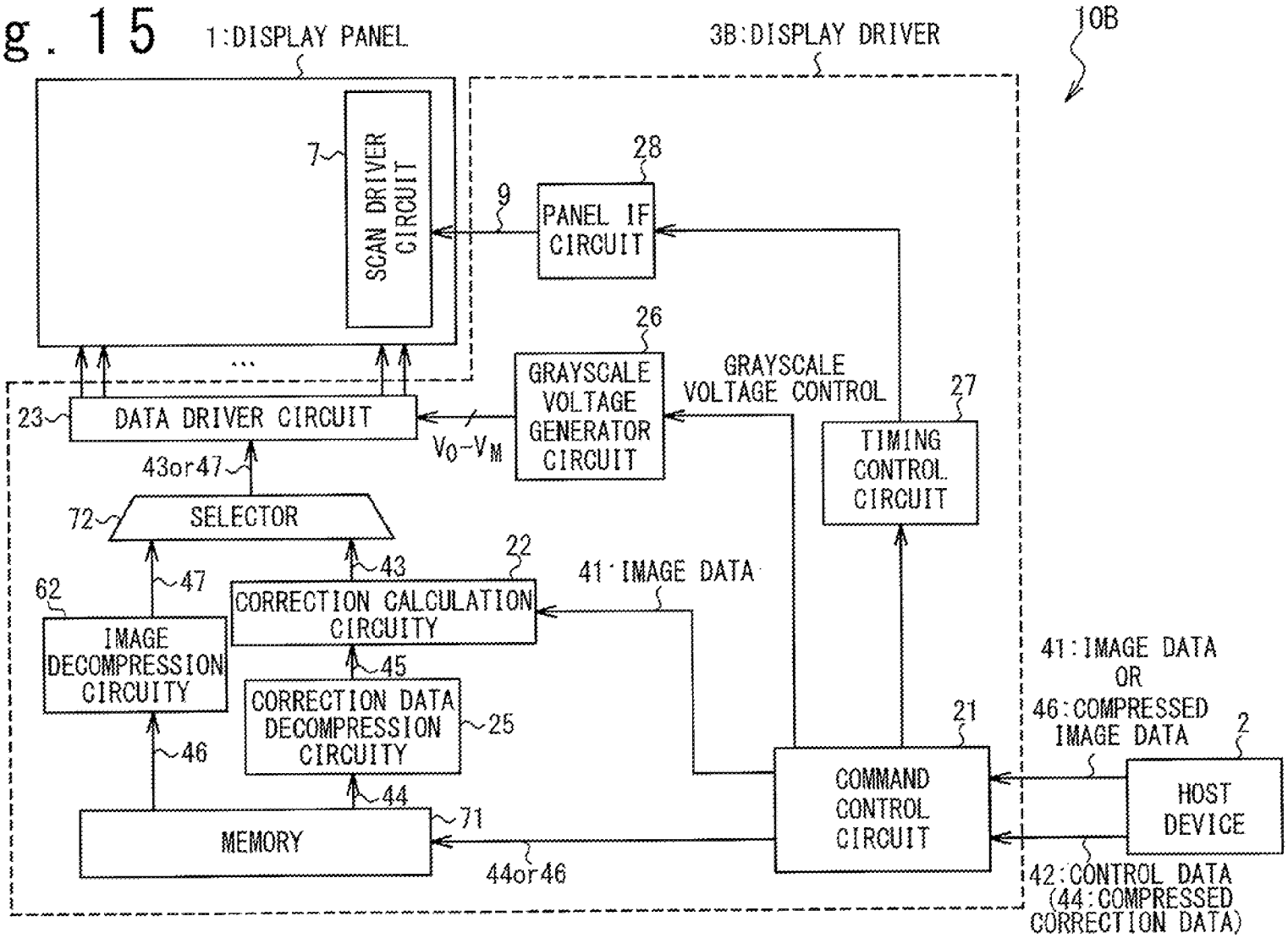
FIG. 15 is a block diagram illustrating the configuration of a display system in a third embodiment.

FIG. 15 is a block diagram illustrating the configuration of the display system 10B, more particularly to a display driver 3B in a third embodiment. The configuration of the display system 10B of the third embodiment is similar to those of the display system 10 of the first embodiment and the display system 10A of the second embodiment. It should be noted however that the display system 10B of the third embodiment is configured to be adapted to both of the operations of the display system 10 of the first embodiment and the display system 10A of the second embodiment. The display system 10B of the third embodiment is configured to selectively perform a selected one of the operations of the first and second embodiments, in response to the setting of the operation mode.

In the third embodiment, the display driver 3B includes the correction calculation circuitry 22, the correction data decompression circuitry 25, the image decompression circuitry 62, a memory 71 and a selector 72. In the present embodiment, the memory 71 is used to store both of the compressed correction data 44 and the compressed image data 46.

The configurations and operation of the correction calculation circuitry 22 and the correction data decompression circuitry 25 is as described in the first embodiment. The correction data decompression circuitry 25 receives the compressed correction data 44 from the memory 71 and performs the decompression process on the received compressed correction data 44 to generate the decompressed correction data 45. The correction calculation circuitry 22 generates the corrected image data 43 by correcting the image data on the basis of the decompressed correction data 45.

Meanwhile, the configuration and operation of the image decompression circuitry 62 is as described in the second embodiment. The image decompression circuitry receives the compressed image data 46 from the memory and generates the decompressed image data 47 by performing the decompression process on the received compressed image data 46.

The selector 72 selects one of the correction calculation circuitry 22 and the image decompression circuitry 62 in response to the operation mode, and connects the output of the selected circuitry to the data driver circuit 23. The operation of the selector 72 allows the display system 10B of the present embodiment to selectively perform the operations of the first and second embodiment.

Figure 16:
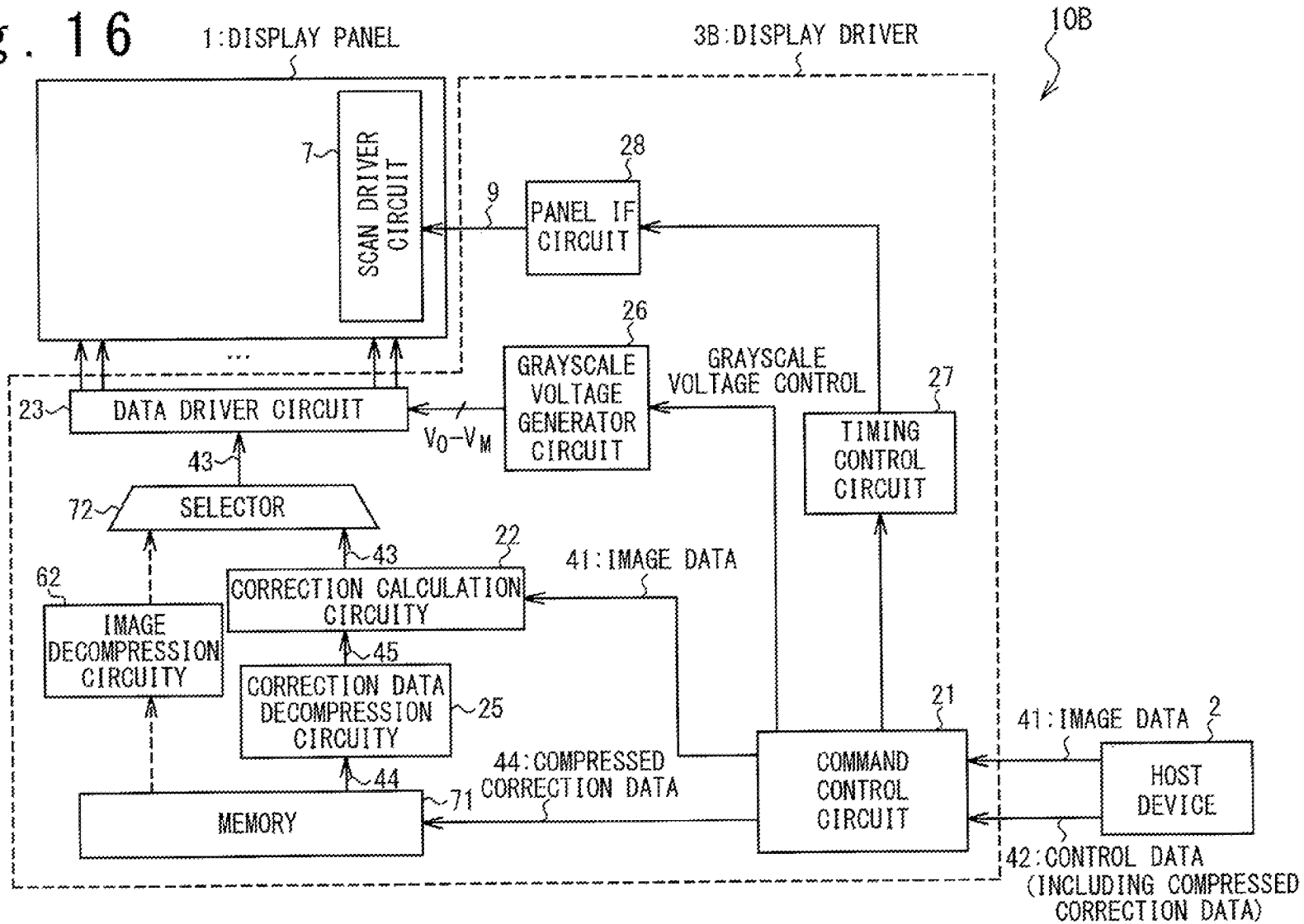
FIG. 16 is a block diagram illustrating the operation of the display system in the third embodiment.

FIG. 16 is a block diagram illustrating the operation of the display system 10B of the third embodiment, when the display system 10B is placed in the first operation mode. When placed in the first operation mode, the display system 10B of the third embodiment operates similarly to the display system 10 of the first embodiment. The selector 72 selects the correction calculation circuitry 22 and supplies the corrected image data 43 received from the correction calculation circuitry to the data driver circuit 23. More specifically, the display system 10B of the third embodiment operates as follows, when placed in the first operation mode.

Before image displaying, the compressed correction data 44 is supplied from the host device 2 to the display driver 3B and written into the memory 71. When an image is subsequently displayed on the display panel 1, image data 41 corresponding to the image is supplied from the host device 2 to the display driver 3B. The image data 41 supplied to the display driver 3B is supplied to the correction calculation circuitry 22.

In the meantime, the compressed correction data is read out from the memory 71 and supplied to the correction data decompression circuitry 25. The correction data decompression circuitry 25 decompresses the compressed correction data 44 to generate the decompressed correction data 45. The decompressed correction data 45 is generated for the respective subpixels (the R subpixels 6R, G subpixels 6G and B subpixels 6B) of the pixels 8 of the display panel 1.

The correction calculation circuitry 22 corrects the image data 41 in response to the decompressed correction data 45 received from the correction data decompression circuitry 25 to generate the corrected image data 43. In correcting the image data 41 associated with a certain subpixel of a certain pixel 8, the decompressed correction data 45 associated with the certain subpixel of the certain pixel 8 is used to thereby generate the corrected image data 43 associated with the certain subpixel of the certain pixel 8. The corrected image data thus generated is transmitted to the data driver circuit 23 and used to drive the respective subpixels of the respective pixels 8 of the display panel 1.

Figure 17:
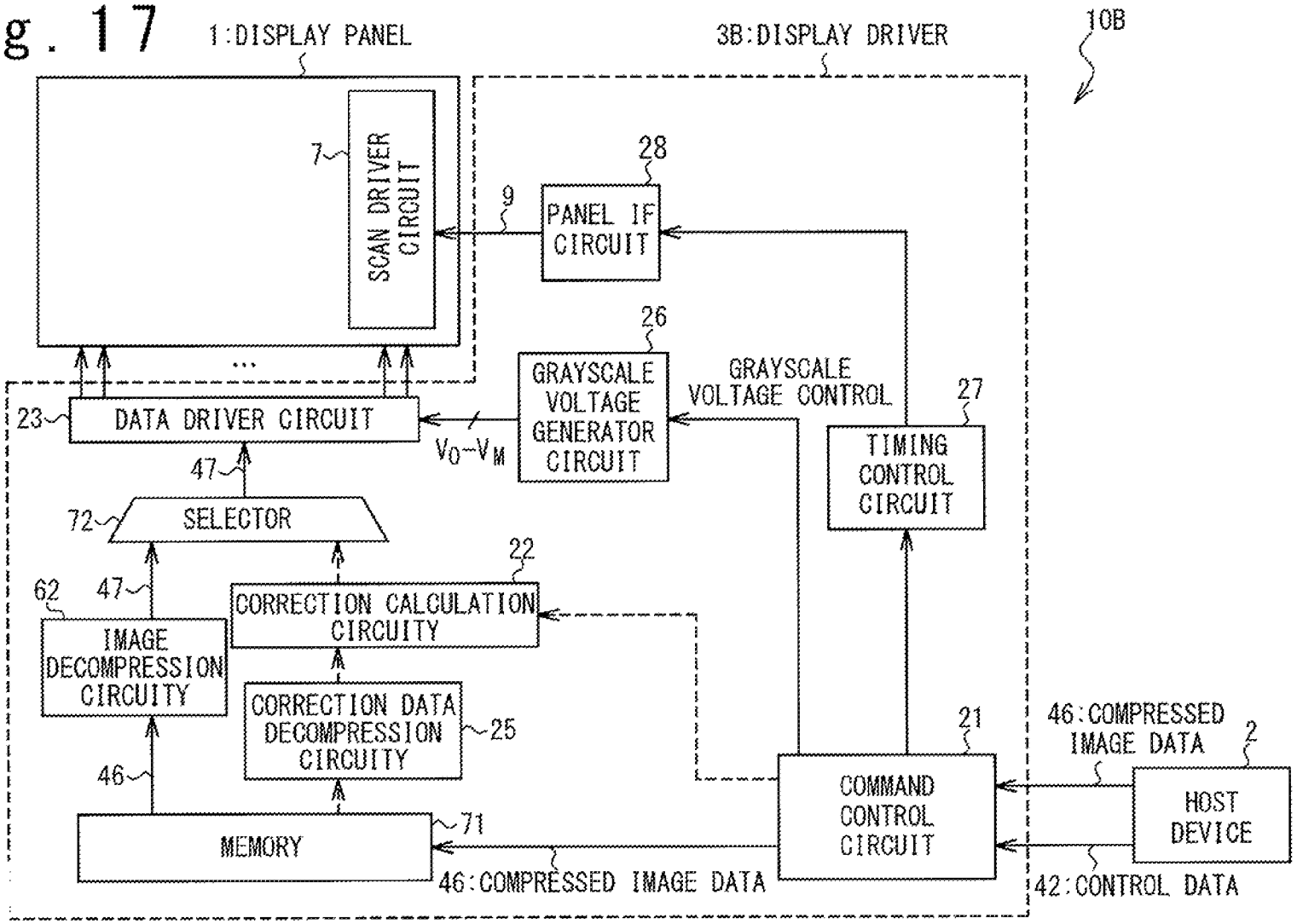
FIG. 17 is a block diagram illustrating the operation of the display system in the third embodiment.

FIG. 17 is a block diagram illustrating the operation of the display system 10B of the third embodiment, when the display system 10B is placed in a second operation mode. When placed in the second operation mode, the display system 10B of the third embodiment operates similarly to the display system 10A of the second embodiment. The selector 72 selects the image decompression circuitry 62 and supplies the decompressed image data 47 received from the image decompression circuitry 62 to the data driver circuit 23. The decompressed image data 47 thus generated is are transmitted to the data driver circuit 23 and used to drive the respective subpixels of the respective pixels 8 of the display panel 1.

The display system 10B of the third embodiment is adapted to both of the operations performed in the first and second embodiments. In the meantime, the display system 10B of the third embodiment, in which the memory 71 is used for both of the operations performed in the first and second embodiments, effectively suppresses an increase in the circuitry size.

Although embodiments of the present invention have been specifically described, the present invention is not limited to the above-described embodiments. A person skilled in the art would appreciate that the present invention may be implemented with various modifications.

What is claimed is:

1. A display system, comprising:

a display panel comprising subpixels of pixels;

a host device configured to:

divide first original data respectively associated with the subpixels into first data streams, wherein the first original data comprises correction data defined for each of the subpixels;

generate compressed data streams from the first data streams;

divide each of the compressed data streams into blocks; and sort the blocks into first sorted blocks; and a display driver configured to drive the display panel, the display driver comprising:

a memory configured to store the first sorted blocks sequentially received from the host device;

decompression circuitry configured to perform a decompression process on the first sorted blocks to generate first decompressed data comprising decompressed correction data corresponding to the correction data; and drive circuitry configured to drive subpixels based at least in part on the decompressed correction data of the first decompressed data.

2. The display system according to claim 1, wherein the host device is further configured to determine an order in which the blocks are sorted.

3. The display system according to claim 1, wherein the correction data is defined for each of the subpixels, wherein the host device is further configured to transmit image data specifying grayscale values of the subpixels to the display driver, wherein the display driver further includes correction calculation circuitry configured to generate corrected image data associated with a first subpixel of the subpixels by correcting image data associated with the first subpixel based on a portion of the first decompressed data associated with the first subpixel, and the drive circuitry is further configured to drive the first subpixel in response to the corrected image data.

4. The display system according to claim 1, wherein the first original data includes original image data specifying grayscale values of the subpixels, the first decompressed data includes decompressed image data corresponding to the first original data, and wherein the drive circuitry is further configured to drive the subpixels based on the decompressed image data.

5. The display system according to claim 1, wherein the display driver further includes correction calculation circuitry, wherein, when the display system is in a first operation mode:

the host device is configured to:

divide second original data respectively associated with subpixels into second data streams, the second original data includes original image data specifying grayscale values of the subpixels;

the decompression circuitry is further configured to perform a decompression process on second sorted blocks generated from the second data streams to generate second decompressed data, the second decompressed data including decompressed image data corresponding to the second original data; and the drive circuitry is further configured to drive the subpixels in response to the decompressed image data, wherein, when the display system is in a second operation mode:

the host device is configured to transmit image data specifying grayscale values of the subpixels to the display driver, the correction calculation circuitry is configured to generate corrected image data by correcting the image data at least partially based on the decompressed correction data; and the drive circuitry is further configured to drive the subpixels based on the corrected image data, and wherein, in the second operation mode, the corrected image data associated with a first subpixel of a first pixel of the pixels is generated by correcting a portion of the image data associated with the first subpixel based on the decompressed correction data associated with the first subpixel.

6. The display system according to claim 1, wherein the blocks are supplied from the memory to the decompression circuitry in an order in which the blocks are supplied from the host device to the memory.

7. The display system according to claim 1, wherein the display driver further includes correction calculation circuitry configured to generate corrected image data by correcting image data associated with the subpixels based on the decompressed correction data associated with the subpixels, and wherein the drive circuitry is further configured to drive the subpixels at least partially based on the corrected image data.

8. The display system according to claim 1, wherein the first original data includes original image data specifying grayscale values of the subpixels, and the first decompressed data further includes decompressed image data corresponding to the first original data.

9. The display system according to claim 1, wherein the display driver further comprises correction calculation circuitry, wherein in a first operation mode:

the drive circuitry is further configured to drive the subpixels based on second decompressed data, the second decompressed data including decompressed image data corresponding to second original data specifying grayscale values of the subpixels; and in a second operation mode:

the host device is further configured to transmit image data specifying grayscale values of the subpixels;

the correction calculation circuitry is configured to generate corrected image data by correcting a portion of the image data associated with a first subpixel of a first pixel of the pixels based on the first decompressed data; and the drive circuitry is further configured to drive the subpixels in response to the corrected image data.

10. The display system according to claim 1, wherein the blocks are fixed-length blocks.

11. A host device to be used in a display system including a display driver configured to drive a display panel, the host device comprising:

a processor configured to:

divide original data respectively associated with subpixels of pixels of the display panel into data streams, wherein the original data comprises correction data defined for each of the subpixels;

generate compressed data streams from the data streams;

divide each of the compressed data streams into blocks;

sort the blocks; and sequentially transmit the sorted blocks to the display driver, wherein the display driver includes:

a memory configured to store the sorted blocks sequentially received from the host device;

decompression circuitry configured to perform a decompression process on the sorted blocks to generate decompressed data comprising decompressed correction data corresponding to the correction data; and drive circuitry configured to drive the subpixels at least partially based on the decompressed correction data of the decompressed data.

12. The host device according to claim 11, wherein the processor is further configured to determine an order in which the blocks are sorted.

13. The host device according to claim 11, wherein generating compressed data includes one of generating the compressed data based on fixed rate compression and generating the compressed data based on variable rate compression.

14. The host device according to claim 11, wherein the host device is further configured to sort the blocks to supply the blocks to the memory of the display driver based on an order that the blocks are requested.

15. A non-transitory storage medium storing a program when executed causes a host device included in a display system including a display driver configured to drive a display panel to perform the following steps of:

dividing original data respectively associated with subpixels of pixels of the display panel into data streams, the original data comprises correction data defined for each of the subpixels;

generating compressed data streams from the data streams;

dividing each of the compressed data streams into blocks; and sorting the blocks and sequentially transmitting the sorted blocks to the display driver, wherein the display driver is configured to:

store the sorted blocks in a memory:

generate decompressed data by performing a decompression process on the sorted blocks, wherein the decompressed data comprises decompressed correction data corresponding to the correction data; and drive the subpixels at least partially based on the decompressed correction data of the decompressed data.

16. The non-transitory storage medium according to claim 15, wherein when executed the program further causes the host device to determine an order in which the blocks are sorted.

17. The non-transitory storage medium according to claim 15, wherein when executed the program further causes the host device to generate the compressed data streams based on fixed rate compression and generating the compressed data streams based on variable rate compression.

18. A display driver configured to drive a display panel, comprising:

a memory configured to store first sorted blocks received from a host device, the first sorted blocks derived from first compressed data streams associated with subpixels of pixels of the display panel, wherein the first compressed data streams are generated by dividing first original data associated with the subpixels, the first original data including correction data for the subpixels;

decompression circuitry configured to generate first decompressed data using the first sorted blocks, the first decompressed data includes decompressed correction data corresponding to the correction data; and drive circuitry configured to drive the subpixels using the decompressed correction data of the first decompressed data.

19. The display driver according to claim 18, wherein the display driver further comprises:

correction calculation circuitry configured to generate corrected image data by correcting image data in response to the decompressed correction data, wherein the correction calculation circuitry is further configured to generate the corrected image data associated with a first subpixel of a first pixel of the pixels by correcting a portion of the image data associated with the first subpixel in response to a portion of the decompressed correction data associated with the first subpixel, and wherein the drive circuitry is further configured to drive the subpixels based on the corrected image data.

20. The display driver according to claim 18, wherein the first original data further includes original image data specifying grayscale values of the subpixels, wherein the first decompressed data includes decompressed image data corresponding to the first original data, and wherein the drive circuitry is further configured to drive the subpixels in response to the decompressed image data.

21. The display driver according to claim 18, and wherein the display driver further includes correction calculation circuitry, wherein, when the display driver is in a first operation mode:

the memory is configured to store second sorted blocks derived from second compressed data streams generated by dividing second original data associated with the subpixels, the second original data includes original image data specifying grayscale values of the subpixels;

the decompression circuitry is configured to generate second decompressed data using the second sorted blocks, the second decompressed data includes decompressed image data corresponding to the second original data; and the drive circuitry is further configured to drive the subpixels at least partially based on the decompressed image data, wherein, when the display driver is in a second operation mode:

the host device is configured to transmit image data specifying grayscale values of the subpixels;

the correction calculation circuitry is further configured to generate corrected image data by correcting the image data in response to the decompressed correction data; and the drive circuitry is further configured to drive the subpixels in response to the corrected image data, and wherein, in the second operation mode, the corrected image data associated with a first subpixel of a first pixel of the pixels is generated by correcting a portion of the image data associated with the first subpixel in response to a first portion of the decompressed correction data associated with the first subpixel.

* * * * *